US011841672B1

(12) United States Patent
Kaneko et al.

(10) Patent No.: US 11,841,672 B1
(45) Date of Patent: Dec. 12, 2023

(54) IMAGE FORMING APPARATUS

(71) Applicant: FUJIFILM Business Innovation Corp., Tokyo (JP)

(72) Inventors: Atsushi Kaneko, Kanagawa (JP); Toshio Takiguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/973,973

(22) Filed: Oct. 26, 2022

(30) Foreign Application Priority Data

May 18, 2022 (JP) ..... 2022-081759

(51) Int. Cl.
*G03G 15/00* (2006.01)
*G03G 21/16* (2006.01)
*G03G 21/12* (2006.01)

(52) U.S. Cl.
CPC ..... *G03G 21/1633* (2013.01); *G03G 21/12* (2013.01); *G03G 21/1661* (2013.01)

(58) Field of Classification Search
CPC .... G03G 15/00; G03G 15/5025; G03G 21/12; G03G 21/1633; G03G 21/1661
USPC ..... 399/107, 110, 111, 113, 114
See application file for complete search history.

(56) References Cited

U.S. PATENT DOCUMENTS 9,014,594 B2 * 4/2015 Okabe ..... G03G 21/1671 399/110
9,869,965 B2 * 1/2018 Inada ..... G03G 21/1633
11,119,438 B2 * 9/2021 Sato ..... G03G 15/0886

FOREIGN PATENT DOCUMENTS

JP 2000-338840 A 12/2000
JP 2002156889 * 5/2002
JP 2002-196648 A 7/2002
JP 2005-165180 A 6/2005

* cited by examiner

*Primary Examiner* — Hoan H Tran
(74) *Attorney, Agent, or Firm* — Oliff PLC

(57) ABSTRACT

An image forming apparatus includes: a detachable body that is able to be attached to and detached from an image forming apparatus body in a depth direction and is movable from a first position to a second position; an operation unit that is operated in a direction approaching the image forming apparatus body to position the detachable body from the first position to the second position; and a pressing member that presses the detachable body toward the second position with a pressing surface in contact with the detachable body in a state in which an operation of the operation unit is completed and moves the detachable body from the first position to the second position with a slope surface forming an obtuse angle with respect to the pressing surface in contact with the detachable body in accordance with the operation of the operation unit.

18 Claims, 22 Drawing Sheets

IMAGE FORMING APPARATUS

CROSS-REFERENCE TO RELATED APPLICATIONS

This application is based on and claims priority under 35 USC 119 from Japanese Patent Application No. 2022-081759 filed May 18, 2022.

BACKGROUND

(i) Technical Field

The present disclosure relates to an image forming apparatus.

(ii) Related Art

In Japanese Unexamined Patent Application Publication No. 2002-196648, an electrophotographic image forming apparatus to and from which a process cartridge is able to be attached and detached is disclosed. The electrophotographic image forming apparatus includes operating means capable of being displaced at a first position at which the process cartridge is able to be attached to and detached from an apparatus body and a second position at which the process cartridge is attached and positioned to the apparatus body. When the operating means is not located at the first position or the second position, the operating means is biased toward between the first position and the second position.

In Japanese Unexamined Patent Application Publication No. 2005-165180, an image forming apparatus including a rotary developing device in which a developing device body is rotatably arranged and a plurality of developing units and developer cartridges supplying developer to the developing units are disposed along a direction in which the developing device body rotates, and a replacement cover to and from which the developer cartridges of the rotary developing device are able to be attached and detached, is disclosed. The image forming apparatus includes a lever member that rotates in conjunction with an opening/closing operation of the replacement cover, a rotation operation of the lever member being restricted by interference with part of the developer cartridges that is not attached at an appropriate attachment position of the developing device body, and an abutment member that is provided at the replacement cover and contacts the lever member whose rotation operation is restricted so that the replacement cover becomes unable to be closed in a case where a developer cartridge is not attached at an appropriate attachment position of the developing device body.

SUMMARY

Aspects of non-limiting embodiments of the present disclosure relate to providing an image forming apparatus in which operational force for operating an operation unit is small compared to a configuration in which a detachable body is moved from a first position to a second position with a surface of the operation unit that is perpendicular to a pressing surface of a positioning unit in contact with the detachable body when the operation unit is operated so that the detachable body is positioned.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a detachable body that is able to be attached to and detached from an image forming apparatus body in a depth direction and is movable from a first position to a second position; an operation unit that is operated in a direction approaching the image forming apparatus body to position the detachable body from the first position to the second position; and a pressing member that presses the detachable body toward the second position with a pressing surface in contact with the detachable body in a state in which an operation of the operation unit is completed and moves the detachable body from the first position to the second position with a slope surface forming an obtuse angle with respect to the pressing surface in contact with the detachable body in accordance with the operation of the operation unit.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described in detail with reference to drawings. In each of the drawings, an arrow H represents an apparatus up/down direction, which is a vertical direction, an arrow W represents an apparatus width direction, which is a horizontal direction, and an arrow D represents an apparatus depth direction, which is a horizontal direction.

First Exemplary Embodiment

Figure 1:
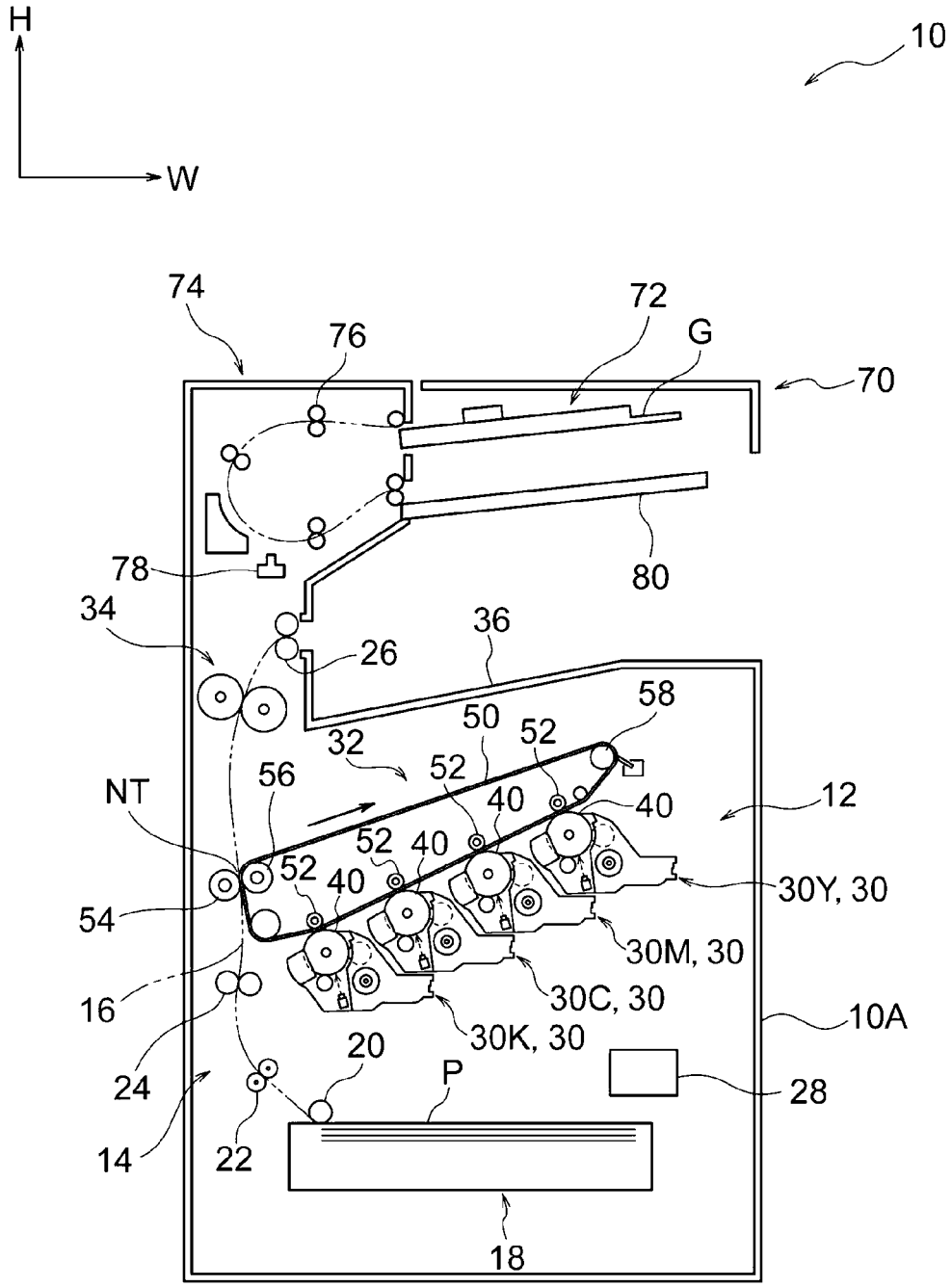
FIG. 1 is a schematic configuration diagram illustrating an image forming apparatus according to a first exemplary embodiment.

FIG. 1 is a schematic configuration diagram illustrating an example of an image forming apparatus according to an exemplary embodiment of the present disclosure.

(Overall Configuration of Image Forming Apparatus)

An image forming apparatus 10 includes, as illustrated in FIG. 1, an image reading device 70 that reads an image formed on a document G, an image forming unit 12 that forms a toner image by an electrophotographic system, and a conveyance unit 14 that conveys a recording medium P along a conveyance path 16. The image forming apparatus 10 also includes a housing member 18 that houses the recording medium P and a controller 28 that controls the entire image forming apparatus 10.

In the image forming apparatus 10 with the configuration described above, an image formed on the document G is read by the image reading device 70. Furthermore, the recording medium P housed in the housing member 18 is conveyed along the conveyance path 16 by the conveyance unit 14. Moreover, a toner image formed by the image forming unit 12 is formed on the recording medium P being conveyed, and the recording medium P on which the toner image is formed is discharged to the outside of an apparatus body 10A, which is an example of an image forming apparatus body.

[Image Forming Unit 12]

The image forming unit 12 includes, as illustrated in FIG. 1, a plurality of toner image forming parts 30 that form toner images of individual colors and a transfer part 32 that transfers the toner images formed by the toner image forming parts 30 to the recording medium P. The image forming unit 12 further includes a fixing device 34 that fixes the toner images transferred to the recording medium P by the transfer part 32 onto the recording medium P.

—Toner Image Forming Parts 30

The toner image forming parts 30 are provided to form toner images of individual colors. In the first exemplary embodiment, the toner image forming parts 30 of four colors: yellow (Y), magenta (M), cyan (C), and black (K), are provided. In the description provided below, when there is no need to distinguish among yellow (Y), magenta (M), cyan (C), and black (K), "Y", "M", "C", and "K" added to reference signs will be omitted.

Figure 2:
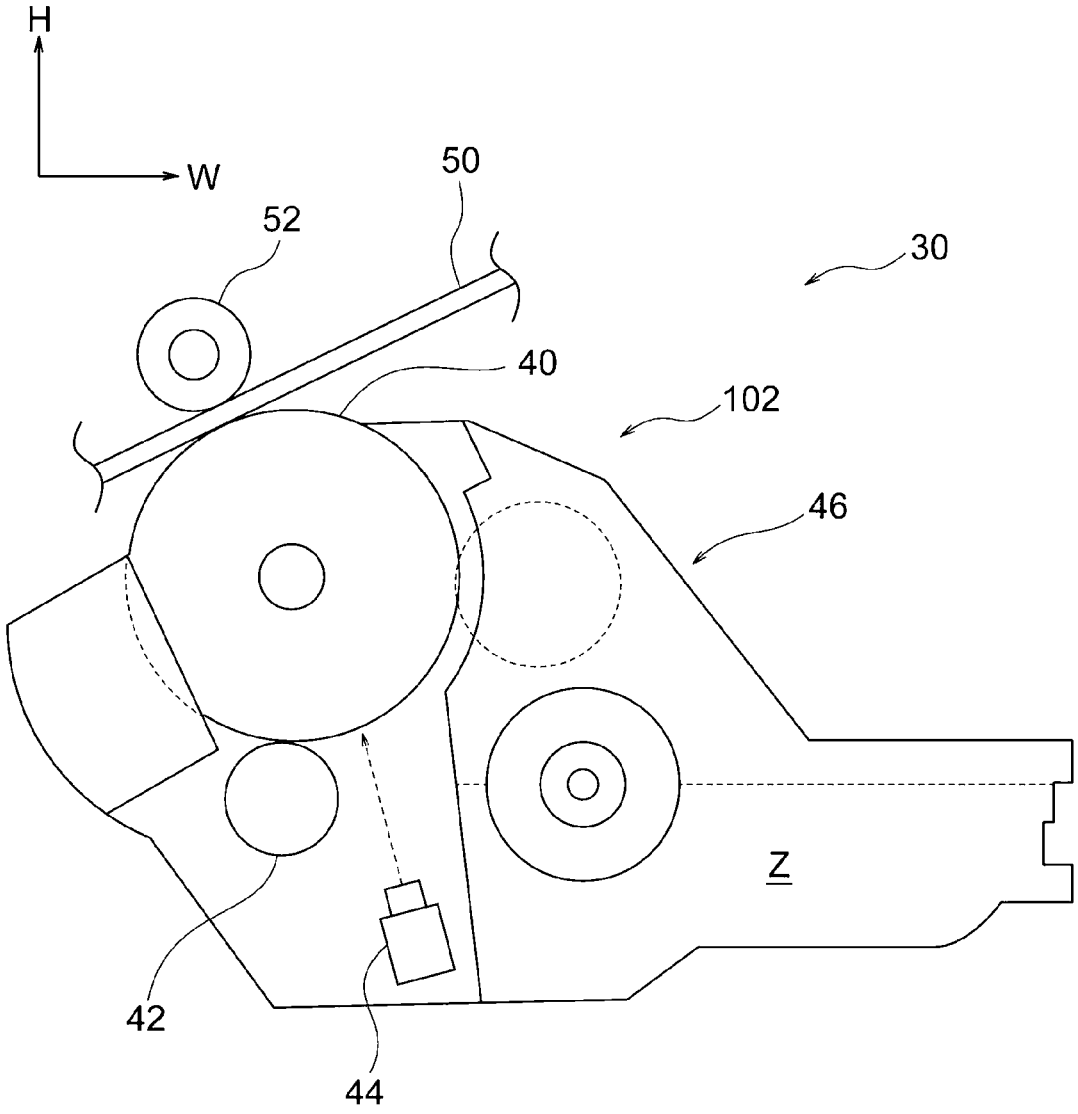
FIG. 2 is a configuration diagram illustrating an image forming unit of the image forming apparatus according to the first exemplary embodiment.

The toner image forming parts 30 of individual colors are configured basically the same, except for toner being used. As illustrated in FIG. 2, the toner image forming parts 30 each include a rotary image holder 40 of a cylindrical shape and a charger 42 that charges the image holder 40. Each of the toner image forming parts 30 further includes an exposure device 44 that irradiates the charged image holder 40 with exposure light to form an electrostatic latent image and a developing device 46 that develops the electrostatic latent image as a toner image using a developer Z containing toner. Thus, the toner image forming parts 30 of individual colors form images of the individual colors using the toner of the individual colors.

The image holders 40 of the individual colors are in contact with a transfer belt 50 (details will be described later) that moves in a circumferential manner, as illustrated in FIG. 1. In a circumferential direction of the transfer belt 50 (see an arrow in FIG. 1), the toner image forming parts 30 of yellow (Y), magenta (M), cyan (C), and black (K) are arranged in this order from an upstream side.

—Transfer Part 32

The transfer part 32 includes, as illustrated in FIG. 1, the transfer belt 50 and primary transfer rolls 52 that are arranged opposite the image holders 40 of individual colors with the transfer belt 50 interposed therebetween and transfer toner images formed on the image holders 40 of the individual colors to the transfer belt 50.

The transfer part 32 further includes a winding roll 56 around which the transfer belt 50 is wound and a driving roll 58 around which the transfer belt 50 is wound and transmits rotational force to the transfer belt 50. Thus, the transfer belt 50 moves in a circumferential manner in the direction of the arrow in FIG. 1.

The transfer part 32 further includes a secondary transfer roll 54 that is arranged opposite the winding roll 56 with the transfer belt 50 interposed therebetween and transfers toner images that has been transferred to the transfer belt 50 to the recording medium P. A transfer nip NT that transfers the toner images to the recording medium P is formed between the secondary transfer roll 54 and the transfer belt 50.

With this configuration, primary transfer of toner images of yellow (Y), magenta (M), cyan (C), and black (K) to the transfer belt 50 is performed in this order by the primary transfer rolls 52. Furthermore, the toner images are transferred by the secondary transfer roll 54 from the transfer belt 50 to the recording medium P, which is conveyed sandwiched between the transfer belt 50 and the secondary transfer roll 54. The recording medium P onto which the toner images have been transferred is conveyed toward the fixing device 34.

—Fixing Device 34

The fixing device 34 is, as illustrated in FIG. 1, arranged downstream the transfer nip NT in the conveyance direction of the recording medium P. The fixing device 34 heats and pressurizes the toner images that have been transferred to the recording medium P to fix the toner images to the recording medium P.

[Conveyance Unit 14]

The conveyance unit 14 includes, as illustrated in FIG. 1, a sending roll 20 that sends the recording medium P housed in the housing member 18 to the conveyance path 16 and a prevention roll 22 that prevents double feeding of the recording medium P that has been sent by the sending roll 20. The conveyance unit 14 further includes an adjustment roll 24 that adjusts the timing at which the recording medium P is sent out to the transfer nip NT and a discharge roll 26 that discharges the recording medium P to which toner images have been fixed by the fixing device 34 to the outside of the apparatus body 10A.

Specifically, the discharge roll 26 conveys the recording medium P from one side (left side in FIG. 1) to the other side (right side in FIG. 1) of the apparatus width direction and discharges the recording medium P to a discharge unit 36 formed at the apparatus body 10A. That is, the direction in which the recording medium P on which images have been formed is discharged is a direction toward the other side of the apparatus width direction. The discharge unit 36 is an example of a first discharge unit.

[Image Reading Device 70]

The image reading device 70 is, as illustrated in FIG. 1, arranged in an upper part of the image forming apparatus 10. The image reading device 70 includes a placement part 72 on which the document G is placed and a conveyance part 74 that is arranged on one side (left side in FIG. 1) in the apparatus width direction relative to the placement part 72 and conveys the document G. The conveyance part 74 conveys the document G using a plurality of conveyance rolls 76. The image reading device 70 further includes a reading unit 78 that reads an image of the document G conveyed by the conveyance part 74 and a discharge unit 80 to which the document G whose image has been read by the reading unit 78 is discharged. The image reading device 70 reads an image contained in the document G. In the image forming apparatus 10, the image forming unit 12 forms an image on the recording medium P in accordance with an image read by the image reading device 70.

(Principal Configuration)

Next, a configuration in which image holder units 102 (see FIG. 3) are attached to the apparatus body 10A, which is a principal configuration of the image forming apparatus 10, will be described.

Figure 3:
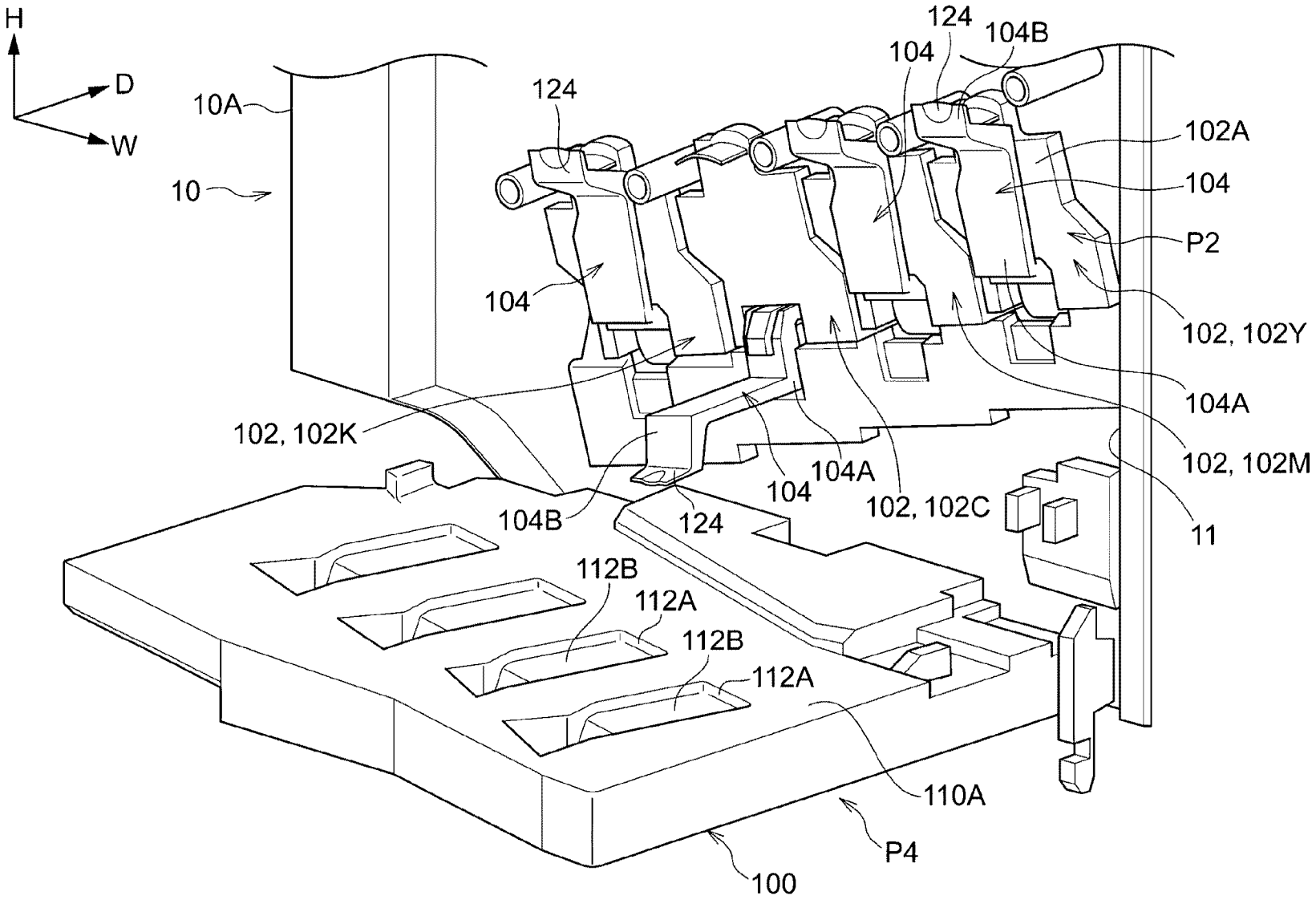
FIG. 3 is a perspective view illustrating a state in which a cover of the image forming apparatus according to the first exemplary embodiment is rotated to an open position at which the inside of the image forming apparatus is exposed.
Figure 7:
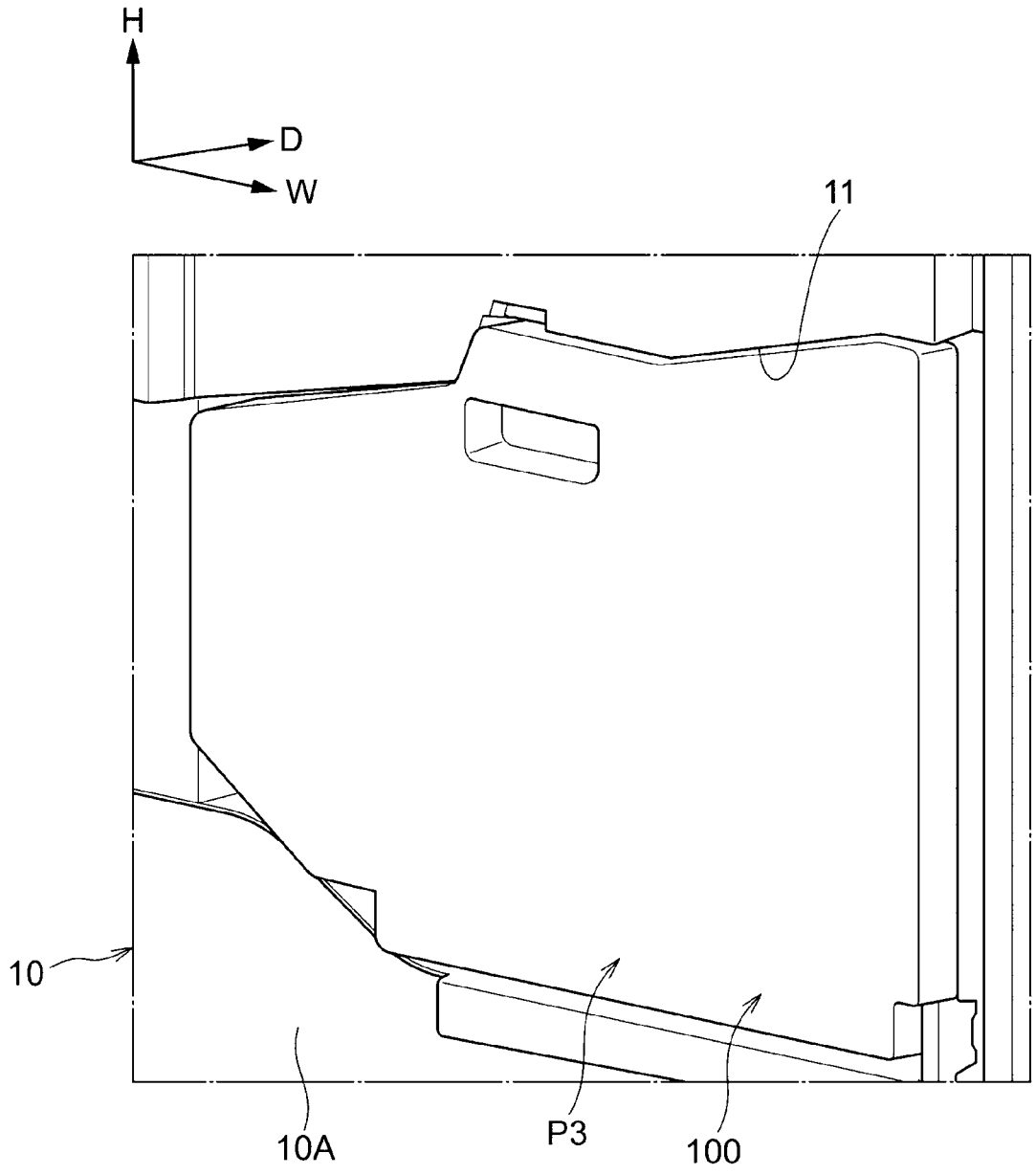
FIG. 7 is a perspective view of an area including and near the cover of the image forming apparatus according to the first exemplary embodiment and illustrates a state in which the cover is rotated to the closed position.

As illustrated in FIG. 3, the image forming apparatus 10 includes a cover 100 that is provided movably between a closed position P3 (see FIG. 7) at which the inside of the apparatus body 10A is covered and an open position P4 (see FIG. 3) at which the inside of the apparatus body 10A is exposed. Furthermore, the image forming apparatus 10 includes, on an inner side of the cover 100, which is inside the apparatus body 10A, the image holder units 102 that are able to be attached to and detached from the apparatus body 10A. The image forming apparatus 10 further includes levers 104 that position the image holder units 102 to a second position P2 in the apparatus body 10A. The cover 100 is an example of a cover member, and the image holder units 102 are an example of detachable bodies. The levers 104 are an example of operation units.

[Image Holder Units 102]

Each of the image holder units 102 includes a housing 102A. For example, the image holder 40, the charger 42, and the developing device 46 (see FIG. 2) are provided inside the housing 102A. Component elements inside the housing 102A may be changed. There is a space in which the image holder units 102 are installed, on an inner side of the cover 100, which is inside the apparatus body 10A. The image holder units 102 are able to be replaced by being detached from and attached to the apparatus body 10A. The image forming apparatus 10 includes, for example, the image holder units 102 of four colors: yellow (Y), magenta (M), cyan (C), and black (K). The image holder units 102 of four colors are detachably attached to the apparatus body 10A (see FIG. 3).

The image holder units 102 are able to be attached to and detached from the apparatus body 10A in the depth direction (D direction). For example, the depth direction (D direction) of the apparatus body 10A is a direction along an axis direction of the image holders 40 of the image holder units 102 (see FIG. 2). The image holder units 102 are movable from a first position P1 (see FIG. 6) different from a position at which the image holder units 102 are positioned to the apparatus body 10A to the second position P2 (see FIG. 8) at which the image holder units 102 are attached and positioned to the apparatus body 10A. That is, the second position P2 is an attachment position at which the image holder units 102 are positioned to the apparatus body 10A.

Figure 10:
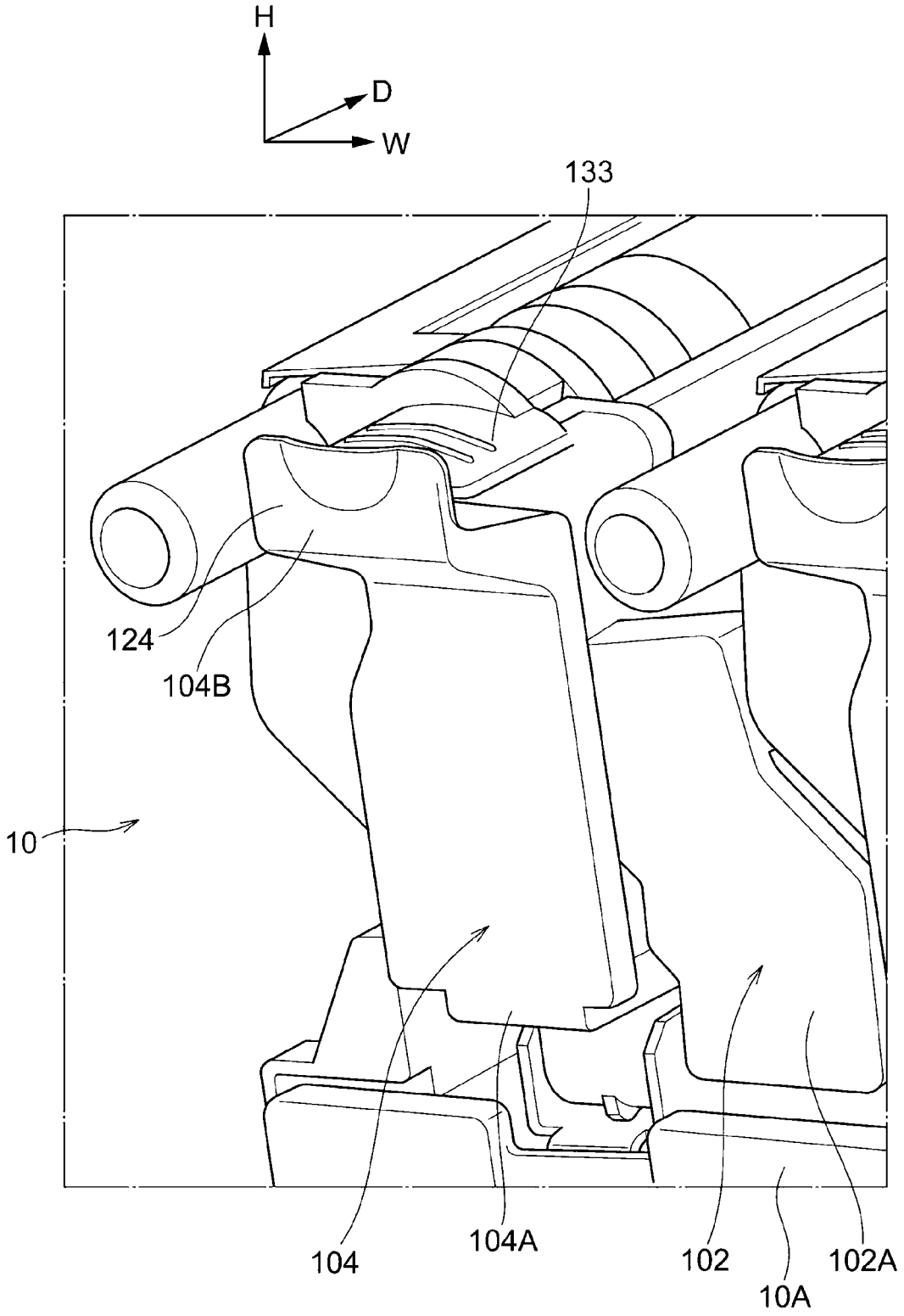
FIG. 10 is a perspective view illustrating a state in which a handle of the lever covers a handle of the image holder unit in the image forming apparatus according to the first exemplary embodiment.

As illustrated in FIG. 10, handles 133 to be gripped by an operator when attaching and detaching the image holder units 102 are provided at the housings 102A of the image holder units 102 near the cover 100 in the depth direction (D direction). Each of the handles 133 extends from a front surface of the housing 102A to the front side in the depth direction (D direction). At least an upper part of the handle 133 has a plurality of protrusions arranged with spaces therebetween along the depth direction (D direction) so that the operator is able to easily grip the handle 133. Thus, the operator is able to attach and detach the image holder units 102 to and from the apparatus body 10A in the depth direction (D direction) while gripping the handles 133.

[Cover 100]

As illustrated in FIG. 3, the cover 100 is moved between the open position P4 (see FIG. 3) and the closed position P3 (see FIG. 7) by causing an upper part of the cover 100 in the up/down direction to rotate around an axis part arranged in a lower part of the cover 100 in the up/down direction. The apparatus body 10A has an opening 11, and the cover 100 covers the opening 11 in a state in which the cover 100 is rotated to the closed position P3 (see FIG. 7). The state in which the cover 100 is at the open position P4 is a state in which the cover 100 is rotated outward relative to the apparatus body 10A. In the state in which the cover 100 is rotated to the open position P4, one end side in the depth direction (D direction) (that is, a front side in the depth direction) of the image holder units 102 inside the apparatus body 10A is exposed.

Figure 4:
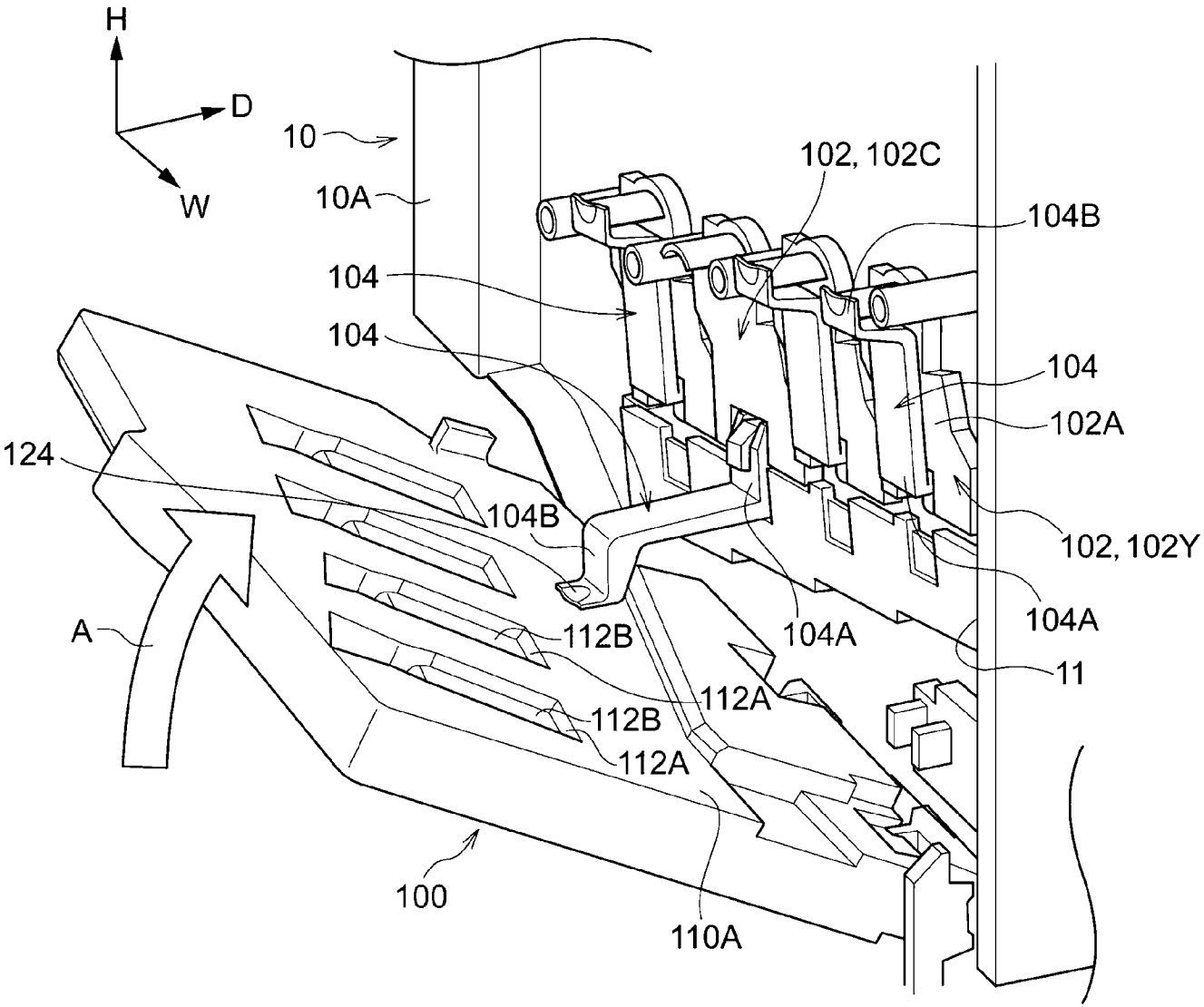
FIG. 4 is a perspective view illustrating a state in which the cover of the image forming apparatus according to the first exemplary embodiment is being rotated toward a closed position at which the inside of the image forming apparatus is covered.
Figure 5:
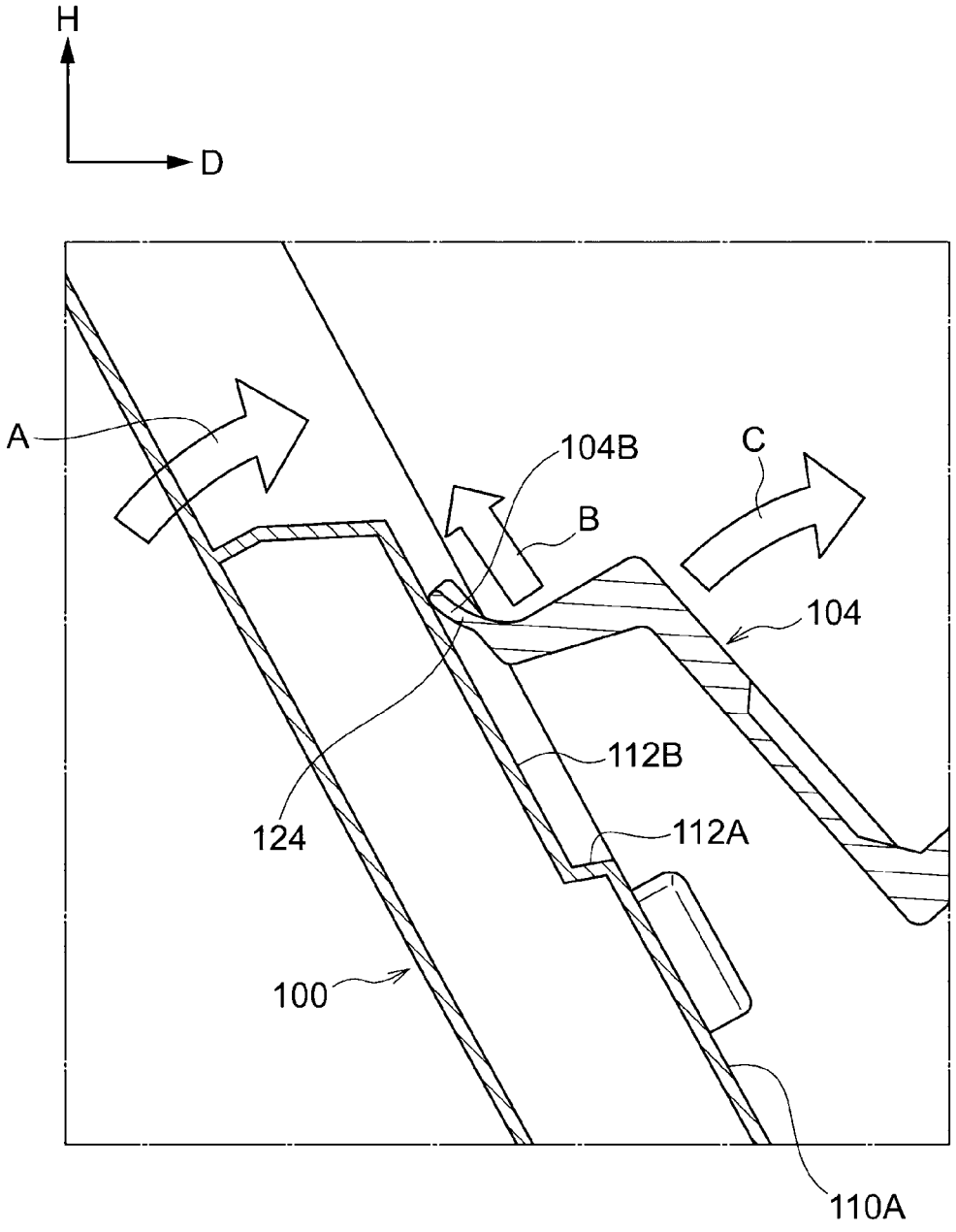
FIG. 5 is an enlarged cross-section view illustrating a state in which the cover of the image forming apparatus according to the first exemplary embodiment is in contact with a lever while the cover is being rotated toward the closed position.

As illustrated in FIGS. 4 and 5, when the cover 100 moves in the direction from the open position P4 to the closed position P3 (arrow A direction), the cover 100 enters in contact with a lever 104 that has not been operated. Then, when the cover 100 rotates in the A direction, the lever 104 slides upward (arrow B direction) while being in contact with an inner surface 112B of the cover 100. Thus, the lever 104 is able to be moved toward the apparatus body 10A (arrow C direction) (see FIG. 5).

The cover 100 has, inside thereof, a flat inner surface 110A along a direction intersecting the thickness direction of the cover 100. The inner surface 110A has recesses 112A that are recessed in the thickness direction of the cover 100, and the recesses 112A each have, inside thereof, the flat inner surface 112B. In the first exemplary embodiment, over the entire operation range of the levers 104 on the cover 100, the inner surface 110A and the inner surfaces 112B that are in contact with the levers 104 are flat surfaces. The inner surface 110A and the inner surfaces 112B are an example of parts that are in contact with the levers 104.

For example, the recesses 112A and the inner surfaces 112B of the cover 100 are arranged at positions corresponding to the four levers 104 that move the four image holder units 102 to the second position P2.

For example, the cover 100 is a collection box that collects waste toner. Although not illustrated in drawings, the cover 100 includes, inside thereof, a housing unit that houses waste toner from the image forming unit 12.

[Levers 104]

Figure 6:
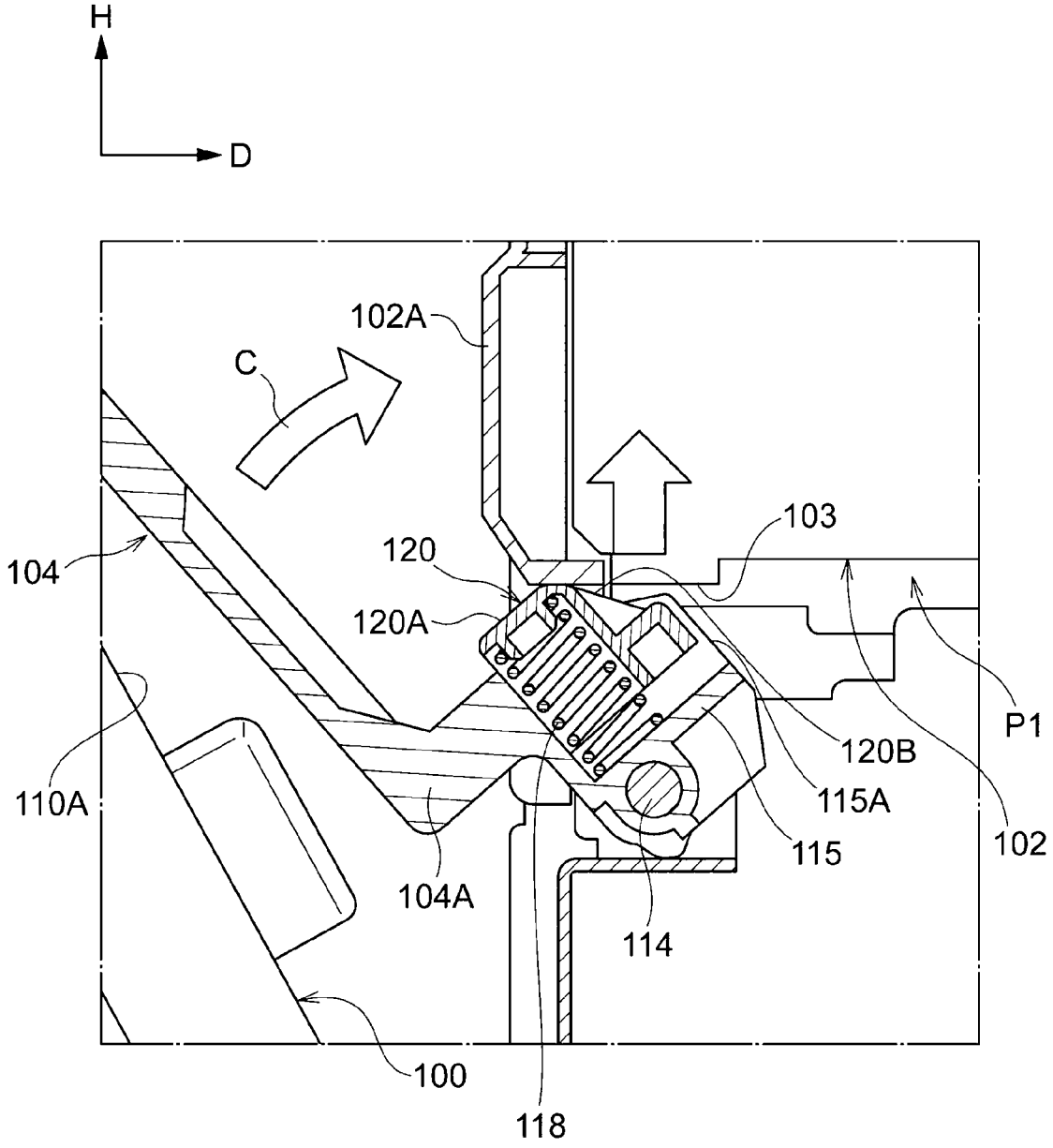
FIG. 6 is an enlarged cross-section view illustrating a state in which a pressing member provided near a base part of the lever moves an image holder unit while the cover of the image forming apparatus according to the first exemplary embodiment is being rotated toward the closed position.

As illustrated in FIGS. 3, 4, and 6, the levers 104 are elongated members and are arranged in such a manner that the longitudinal direction of the levers 104 are along the up/down direction of the apparatus body 10A in a state in which the levers 104 are moved to the apparatus body 10A side. The levers 104 each include a rotational axis 114 in a base part 104A in a lower part in the up/down direction, and a leading end part 104B side rotates in the up/down direction (see FIG. 6). The levers 104 are operated in the direction approaching the apparatus body 10A (the arrow C direction in FIG. 5) when the image holder units 102 are positioned from the first position P1 to the second position P2. For example, the levers 104 are rotatably provided at the apparatus body 10A.

Figure 8:
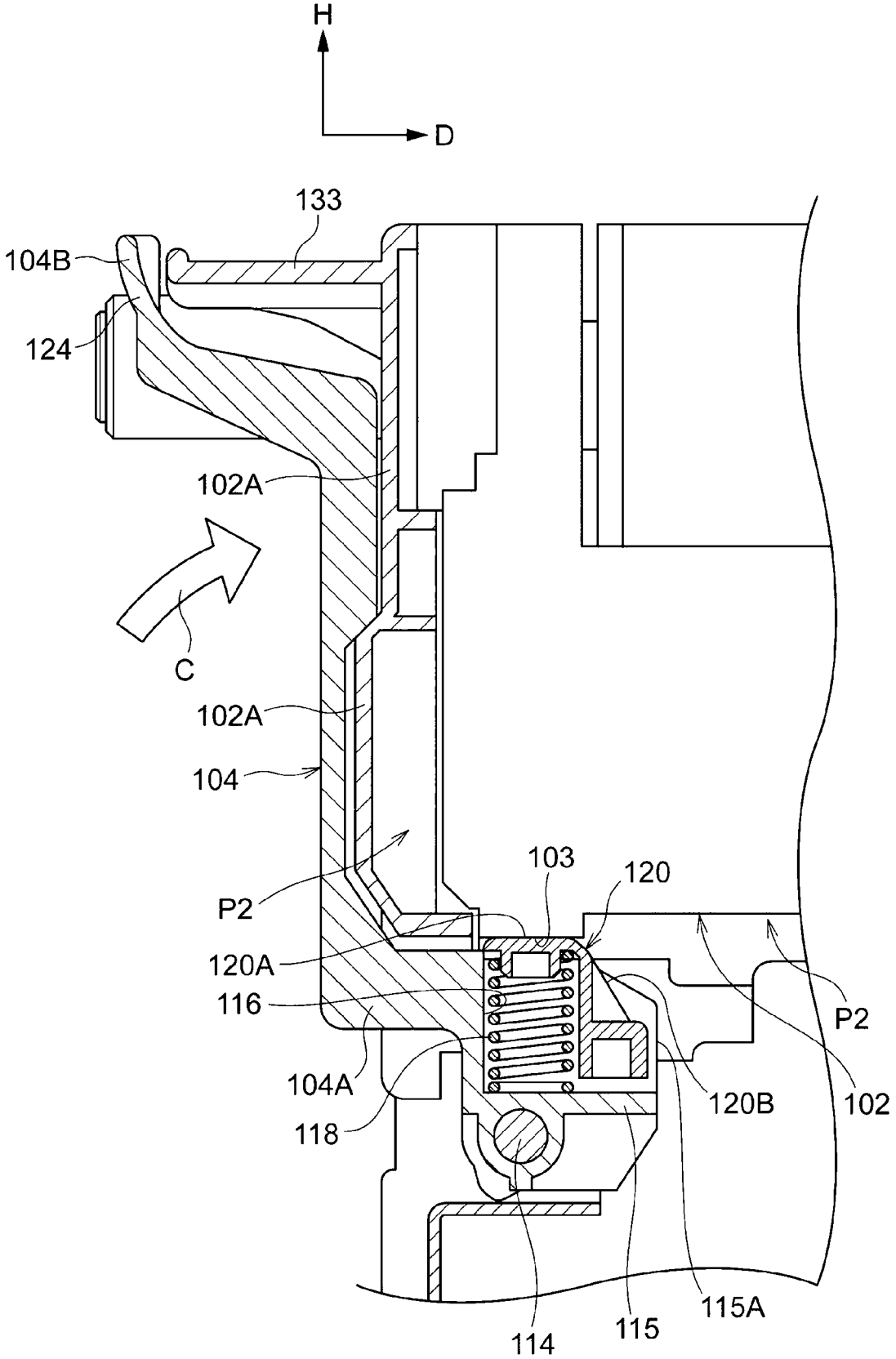
FIG. 8 is a cross-section view of an area including and near the lever and illustrates a state in which the cover of the image forming apparatus according to the first exemplary embodiment is rotated to the closed position.

As illustrated in FIG. 8, at the base part 104A of each of the levers 104, a pressing member 120 that presses the image holder unit 102 toward the second position P2 with a pressing surface 120A in contact with the image holder unit 102 in a state in which operation of the lever 104 is completed, is provided. Furthermore, a coil spring 118, which is an example of a biasing member for biasing the pressing member 120 toward the second position P2, is also provided at the lever 104. The levers 104 each include a supporting part 115 that supports the coil spring 118. The supporting part 115 is formed integrally with the base part 104A. In the first exemplary embodiment, one end of the coil spring 118 is in contact with the supporting part 115, and the other end of the coil spring 118 is in contact with the pressing member 120. Furthermore, the lever 104 is arranged along an extension/compression direction of the coil spring 118 and includes a guide part 116 that guides the pressing member 120.

The pressing surface 120A of the pressing member 120 is arranged in a direction intersecting (for example, a direction orthogonal to) the biasing direction of the coil spring 118. Thus, the pressing member 120 is able to press the image holder unit 102 toward the second position P2 in the biasing direction of the coil spring 118.

As illustrated in FIGS. 6 and 8, the pressing member 120 includes a slope surface 120B that forms an obtuse angle with respect to the pressing surface 120A. The slope surface 120B is provided opposite the cover 100 with the pressing surface 120A therebetween. The pressing member 120 moves the image holder unit 102 from the first position P1 to the second position P2 with the slope surface 120B of the pressing member 120 in contact with the image holder unit 102 in accordance with an operation for rotating the lever 104 in the direction (arrow C direction) approaching the apparatus body 10A.

Desirably, the angle between the pressing surface 120A and the slope surface 120B of the pressing member 120 is equal to or more than 120 degrees and less than or equal to 165 degrees, more desirably equal to or more than 130 degrees and less than or equal to 155 degrees, and further more desirably equal to or more than 135 degrees and less than or equal to 150 degrees.

The supporting part 115 includes a plate-like part, and one end of the coil spring 118 is in contact with the plate-like surface. In the first exemplary embodiment, a wall surface 115A extending along the extension/compression direction of the coil spring 118 is provided, above the supporting part 115, opposite the cover 100 with the coil spring 118 therebetween (see FIGS. 6 and 8). However, a wall surface is not necessarily provided on the supporting part 115.

Figure 9:
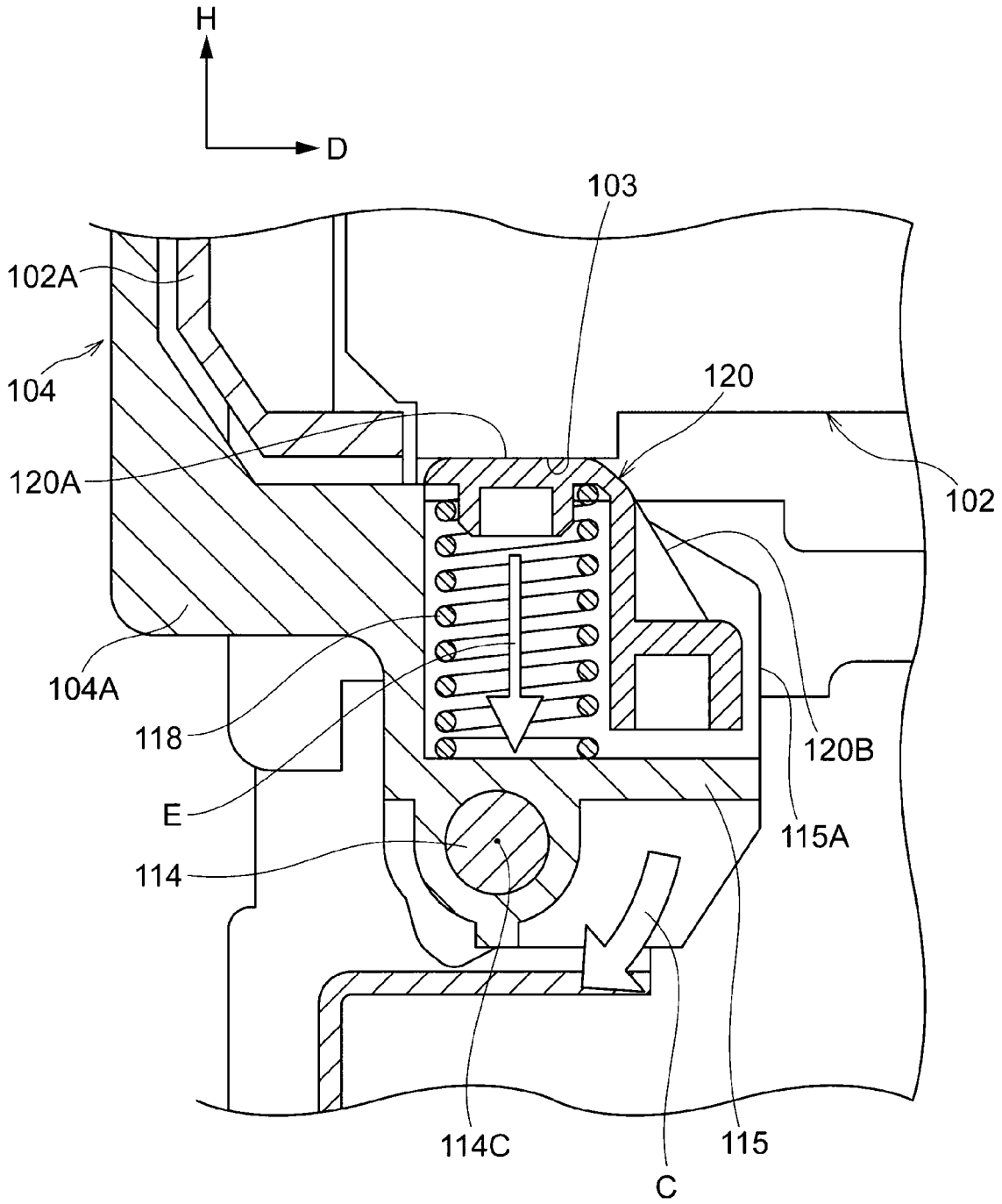
FIG. 9 is a cross-section view of an area including and near the pressing member and illustrates a state in which the cover of the image forming apparatus according to the first exemplary embodiment is rotated to the closed position.

As illustrated in FIG. 9, the center position (position illustrated by arrow E) in the biasing direction of the coil spring 118 is a position at which moment is applied to the rotational axis 114 of the lever 104 in the direction in which the lever 104 is moved toward the apparatus body 10A. That is, the center position (position indicated by the arrow E) in the biasing direction of the coil spring 118 is offset with respect to a center 114C of the rotational axis 114 in the direction in which the cover 100 is closed.

As illustrated in FIG. 3 and other figures, a grip part 124 that is bent in the direction receding from the apparatus body 10A relative to a middle part of the lever 104 is provided at the leading end part 104B of the lever 104. The grip part 124 is, for example, formed in an L-letter shape relative to the middle part of the lever 104 when viewed from a direction along the apparatus width direction (W direction). By gripping the grip part 124 of the lever 104, an operator is able to easily operate the lever 104 in the direction approaching the apparatus body 10A (the arrow C direction in FIG. 5) for positioning the image holder unit 102 to the second position P2 in the apparatus body 10A.

As illustrated in FIG. 3, in the case where the lever 104 has not been operated, the leading end part 104B side of the lever 104 is rotated outward relative to the apparatus body 10A (in this example, the lower side in the up/down direction). The image forming apparatus 10 is configured such that when the cover 100 is rotated toward the closed position P3, the leading end part 104B of the lever 104 that has not been operated enters in plane contact with the cover 100 (see FIGS. 4 and 5). More specifically, the leading end part 104B of the lever 104 that has not been operated enters in contact with the planar inner surface 110A and the planar inner surface 112B of the cover 100. Thus, pressing the lever 104 by the cover 100 enables the lever 104 to be moved toward the apparatus body 10A (that is, the operation direction of the lever 104).

As illustrated in FIG. 10, the grip part 124 of the lever 104 is formed in the L-letter shape as described above. The grip part 124 of the lever 104 has a shape that covers the handle 133 of the image holder unit 102 in a state in which the lever 104 is moved to the apparatus body 10A side.

(Image Forming Apparatus According to First Comparative Example)

A configuration and a problem of an image forming apparatus according to a first comparative example will be described below.

Figure 19:
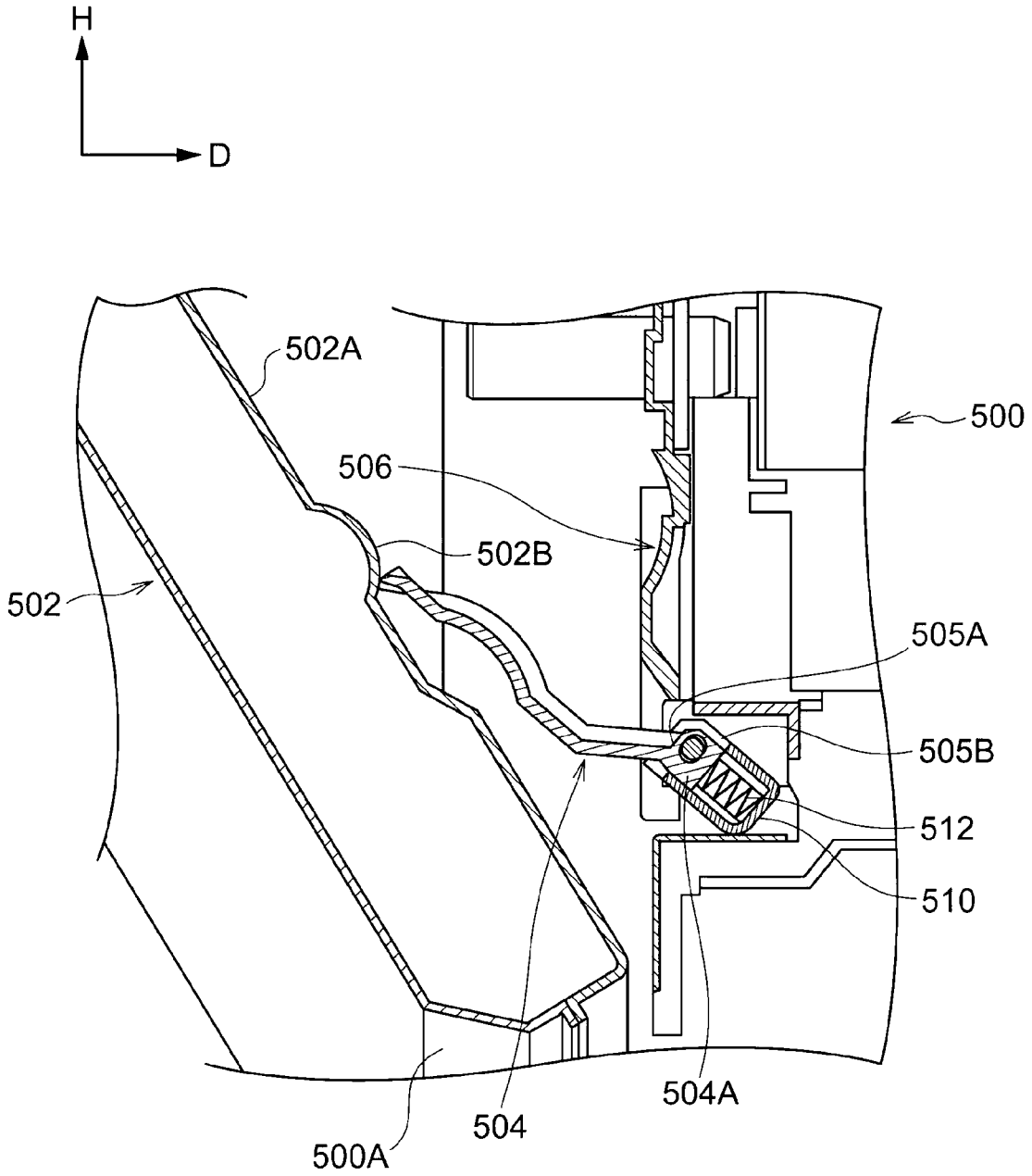
FIG. 19 is a cross-section view illustrating a state in which the lever is caught by a cover of an image forming apparatus according to a first comparative example when the cover is rotated toward the closed position.
Figure 20:
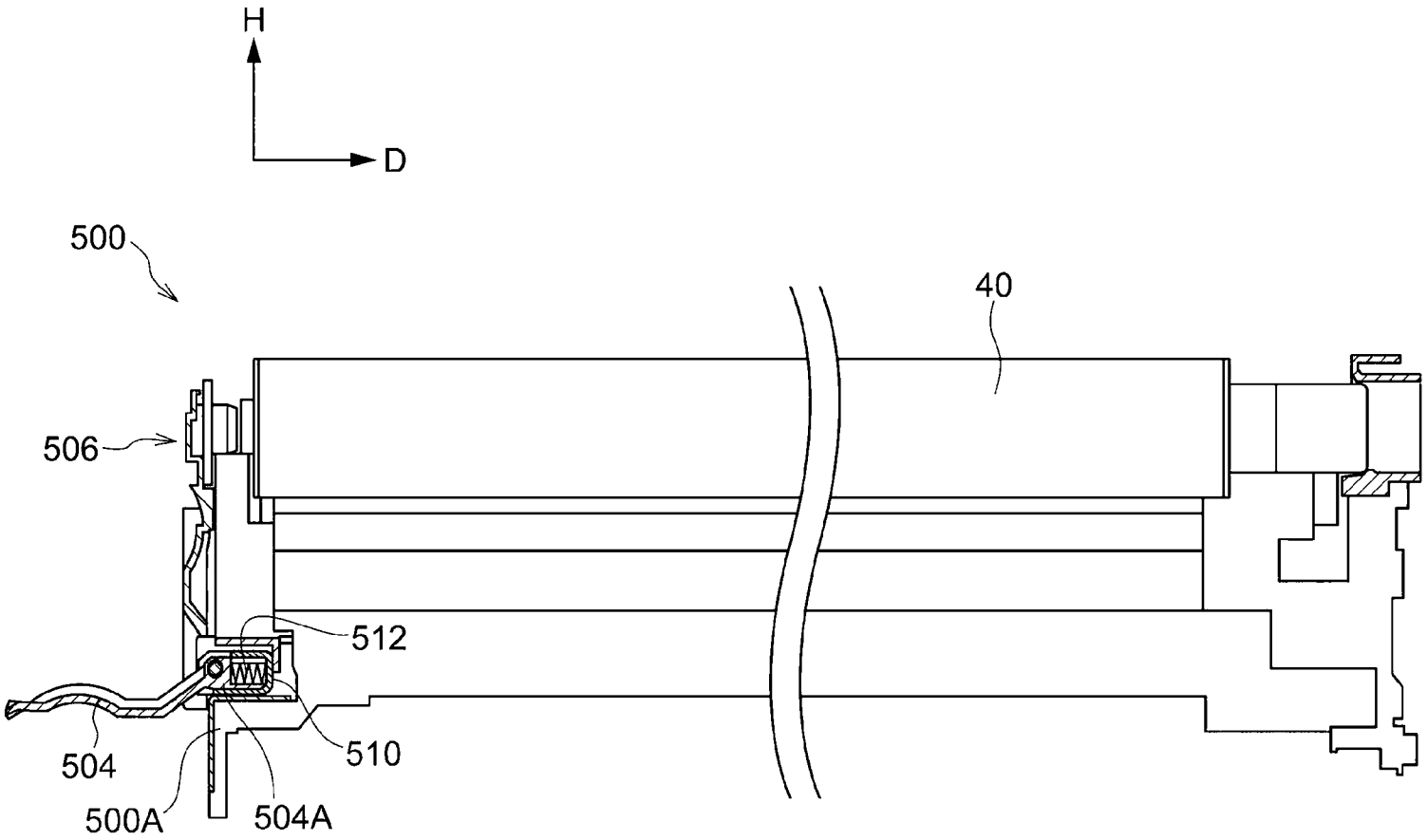
FIG. 20 is a schematic configuration diagram illustrating the lever that fixes an image holder unit of the image forming apparatus according to the first comparative example.

FIG. 19 is an enlarged configuration diagram illustrating an area including and near a cover 502 and a lever 504 of an image forming apparatus 500 according to the first comparative example. As illustrated in FIG. 19, in the image forming apparatus 500, an image holder unit 506 is detachable in a depth direction (D direction) of an apparatus body 500A. As illustrated in FIG. 20, in the image forming apparatus 500, after the image holder unit 506 is inserted into the apparatus body 500A up to the deepest part in the depth direction of the apparatus body 500A, an operation for rotating the lever 504 to the apparatus body 500A side is performed. Thus, the image holder unit 506 is fixed at an attachment position in the apparatus body 500A. The cover 502 is, for example, a collection box that collects waste toner.

Figure 21:
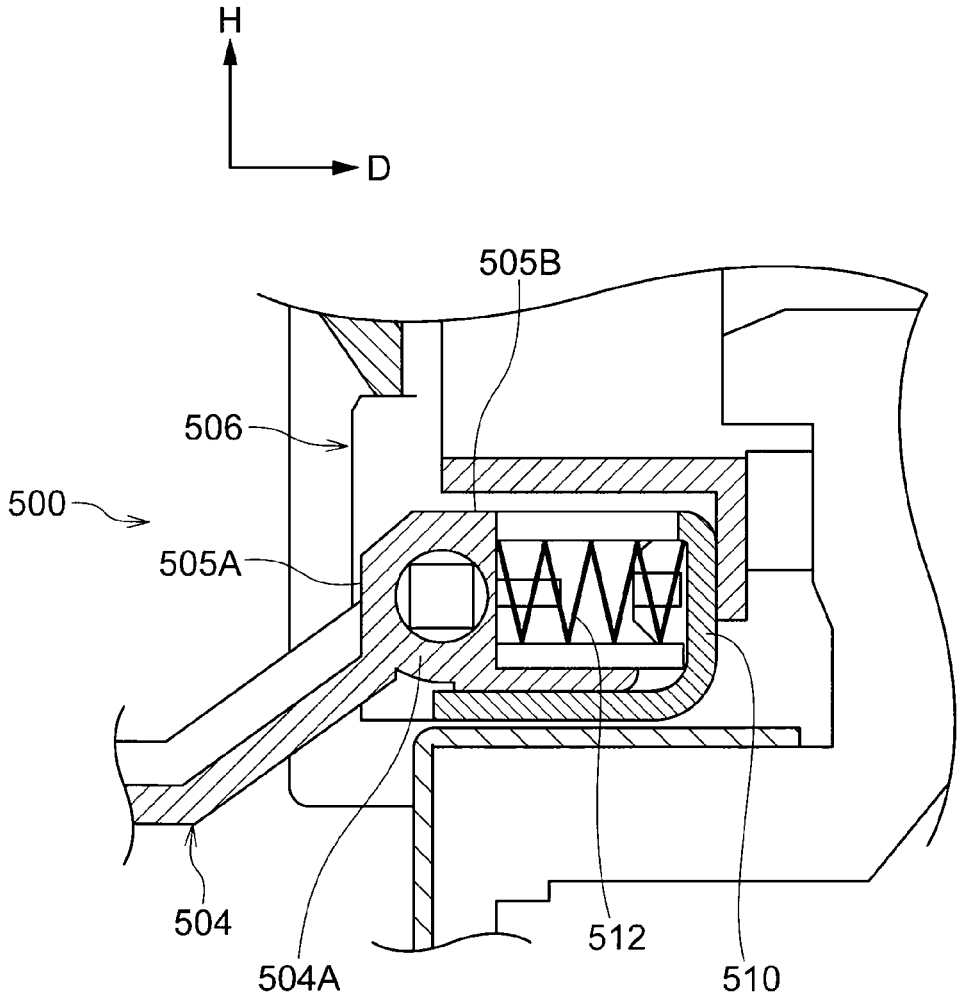
FIG. 21 is a schematic configuration diagram illustrating an area including and near a base part of the lever of the image forming apparatus according to the first comparative example.

As illustrated in FIG. 21, a spring 512 whose one end is in contact with a plunger 510 is provided near a base part 504A of the lever 504. The other end of the spring 512 is in contact with the base part 504A of the lever 504.

In the image forming apparatus 500, the image holder unit 506 includes the lever 504, the plunger 510, and the spring 512. The image holder unit 506 is positioned to the apparatus body 500A by rotating the lever 504 to the apparatus body 500A side and lifting the image holder unit 506 upward while causing the spring 512 to press a guide (installation surface) side of the apparatus body 500A (see FIG. 21).

In the image forming apparatus 500, if the cover 502 is rotated toward the closed position without performing an operation for rotating the lever 504 to the apparatus body 500A side, the cover 502 interferes with the lever 504 (see FIG. 19). Thus, an operator may notice that the lever 504 has not been operated. If the cover 502 is rotated in the closing direction without noticing that the lever 504 has not been operated, a problem described below occurs.

As illustrated in FIG. 19, the spring 512 is arranged between the base part 504A of the lever 504 and the plunger 510. The base part 504A of the lever 504 has a rectangular shape in which an upper corner in the depth direction (D) is notched when viewed in cross section. The base part 504A of the lever 504 has a pressing surface 505A with which the image holder unit 506 is pressed to an attachment position. The base part 504A of the lever 504 has a side surface 505B formed in a direction orthogonal to the pressing surface 505A. When the lever 504 rotates, the side surface 505B enters in contact with the image holder unit 506. That is, the base part 504A of the lever 504 does not have a guiding shape that enables the image holder unit 506 to be moved to the attachment position in the apparatus body 500A when the lever 504 is rotated. Thus, the operational force of the lever 504 is so high that the lever 504 may not be lifted smoothly (may not rotated to the apparatus body 500A side).

Furthermore, an inner surface 502A of the cover 502 has a protruding part 502B that curves so as to avoid a component (not illustrated in FIG. 21) inside the cover 502. Thus, a leading end part of the lever 504 may be caught by the protruding part 502B, and the lever 504 may not be lifted (that is, the lever 504 does not rotate to the apparatus body 500A side).

(Operation and Effect of First Exemplary Embodiment)

Next, operation and effect of the first exemplary embodiment will be described.

The image forming apparatus 10 according to the first exemplary embodiment includes the image holder units 102 that are able to be attached to and detached from the apparatus body 10A in the depth direction (D direction) and are movable from the first position P1 to the second position P2. The image forming apparatus 10 further includes the levers 104 that are operated in the direction approaching the apparatus body 10A for positioning the image holder units 102 from the first position P1 to the second position P2. The image forming apparatus 10 further includes the pressing members 120 that press the image holder units 102 toward the second position P2 with the pressing surfaces 120A of the pressing members 120 in contact with the image holder units 102 in a state in which operation on the levers 104 is completed (see FIG. 8).

In the first exemplary embodiment, the coil springs 118 are arranged between the pressing members 120 and the supporting parts 115, and the coil springs 118 cause the pressing surfaces 120A of the pressing members 120 to press the image holder units 102 toward the second position P2 (see FIG. 8).

Furthermore, each of the pressing members 120 includes the slope surface 120B that forms an obtuse angle with respect to the pressing surface 120A. Thus, as illustrated in FIGS. 6 and 8, the pressing member 120 moves the image holder unit 102 from the first position P1 to the second position P2 with the slope surface 120B in contact with the image holder unit 102 in accordance with an operation of the lever 104.

In the first exemplary embodiment, the slope surface 120B and the pressing surface 120A of the pressing member 120 contact a bottom surface 103 of the image holder unit 102 press the image holder units 102 upward, so that the image holder unit 102 is moved from the first position P1 to the second position P2 (see FIGS. 6 and 8).

Thus, compared to a configuration in which the detachable body is moved from the first position to the second position with a surface of an operation unit that is perpendicular to a pressing surface of a positioning unit in contact with the detachable body when the operation unit is operated so that the detachable body is positioned, operational force for operating the lever 104 in the image forming apparatus 10 is small. For example, compared to the configuration as in the image forming apparatus 500 according to the first comparative example in which the image holder unit 506 is moved to the attachment position with the side surface 505B that is formed at the base part 504A of the lever 504 and is perpendicular to the pressing surface 505A in contact with the image holder unit 506, operational force for operating the lever 104 in the image forming apparatus 10 is small.

Furthermore, the image forming apparatus 10 includes the cover 100 that is provided movably between the closed position P3 at which the inside of the apparatus body 10A is covered and the open position P4 at which the inside of the apparatus body 10A is exposed. When the cover 100 is moved toward the closed position P3, the cover 100 enters in contact with the lever 104 that has not been operated. Furthermore, over the entire operation range of the lever 104 on the cover 100, the inner surface 110A and the inner surface 112B that are in contact with the lever 104 are flat surfaces.

Thus, as illustrated in FIGS. 4 and 5, when the cover 100 moves toward the closed position P3, the inner surface 110A and the inner surface 112B of the cover 100 enter in contact with the leading end part 104B of the lever 104. Therefore, the lever 104 may be pressed upward toward the apparatus body 10A.

Accordingly, compared to the configuration as in the first comparative example in which the lever 504 is caught by the protruding part 502B of the cover 502 when the cover 502 is moved to the closed position, the image holder unit 102 may be positioned to the second position P2 by moving the lever 104 to the apparatus body 10A side when the cover 100 is moved to the closed position P3 in the image forming apparatus 10.

Furthermore, in the image forming apparatus 10, the cover 100 is moved between the open position P4 and the closed position P3 by rotating an upper part of the cover 100 in the up/down direction around an axis part arranged in a lower part in the up/down direction.

Thus, compared to a case where, around an axis part provided at one end of a cover in the width direction, the other end of the cover in the width direction is rotated, positioning of the image holder unit 102 may be performed by smoothly moving the lever 104 to the apparatus body 10A side for moving the cover 100 to the closed position P3 in the image forming apparatus 10.

Furthermore, in the image forming apparatus 10, the cover 100 is a collection box that collects waste toner.

Thus, compared to a cover of a flat plate shape, the cover 100 may be less likely to be deformed when the lever 104 is pressed in the image forming apparatus 10.

Furthermore, in the image forming apparatus 10, the levers 104 are provided at the apparatus body 10A.

Thus, compared to a case where levers are provided at image holding units, cost of the image forming apparatus 10 may be reduced.

Furthermore, in the image forming apparatus 10, the leading end part 104B of the lever 104 that has not been operated is in plane contact with the cover 100.

Thus, compared to a case where a part different from a leading end of a lever that has not been operated is in plane contact with the cover, positioning of the image holder unit 102 may be performed by smoothly moving the lever 104 to the apparatus body 10A side for moving the cover 100 to the closed position P3 in the image forming apparatus 10.

Furthermore, the image forming apparatus 10 includes the coil spring 118 that biases the pressing member 120 toward the second position P2. The center position (see the arrow E) in the biasing direction of the coil spring 118 is a position at which moment is applied to the rotational axis 114 of the lever 104 in the direction in which the lever 104 is moved toward the apparatus body 10A (see FIG. 9).

Thus, compared to a case where a rotational axis of a lever is arranged on a line extended from the center position in the biasing direction of a coil spring, unintentional movement of the lever 104 to the side opposite the apparatus body 10A side may be reduced in the image forming apparatus 10.

Furthermore, in the image forming apparatus 10, the grip part 124 of the lever 104 has a shape that covers the handle 133 of the image holder unit 102 in a state in which the lever 104 is moved to the apparatus body 10A side.

Thus, compared to a configuration which a grip part of a lever does not cover a handle of an image holder unit, an incorrect operation such as drawing out the image holder unit 102 before operating the lever 104 may be reduced in the image forming apparatus 10.

Second Exemplary Embodiment

Next, an image forming apparatus according to a second exemplary embodiment will be described. The same component elements as those in the first exemplary embodiment described above will be denoted by the same numbers and description of those component elements will be omitted.

Figure 11:
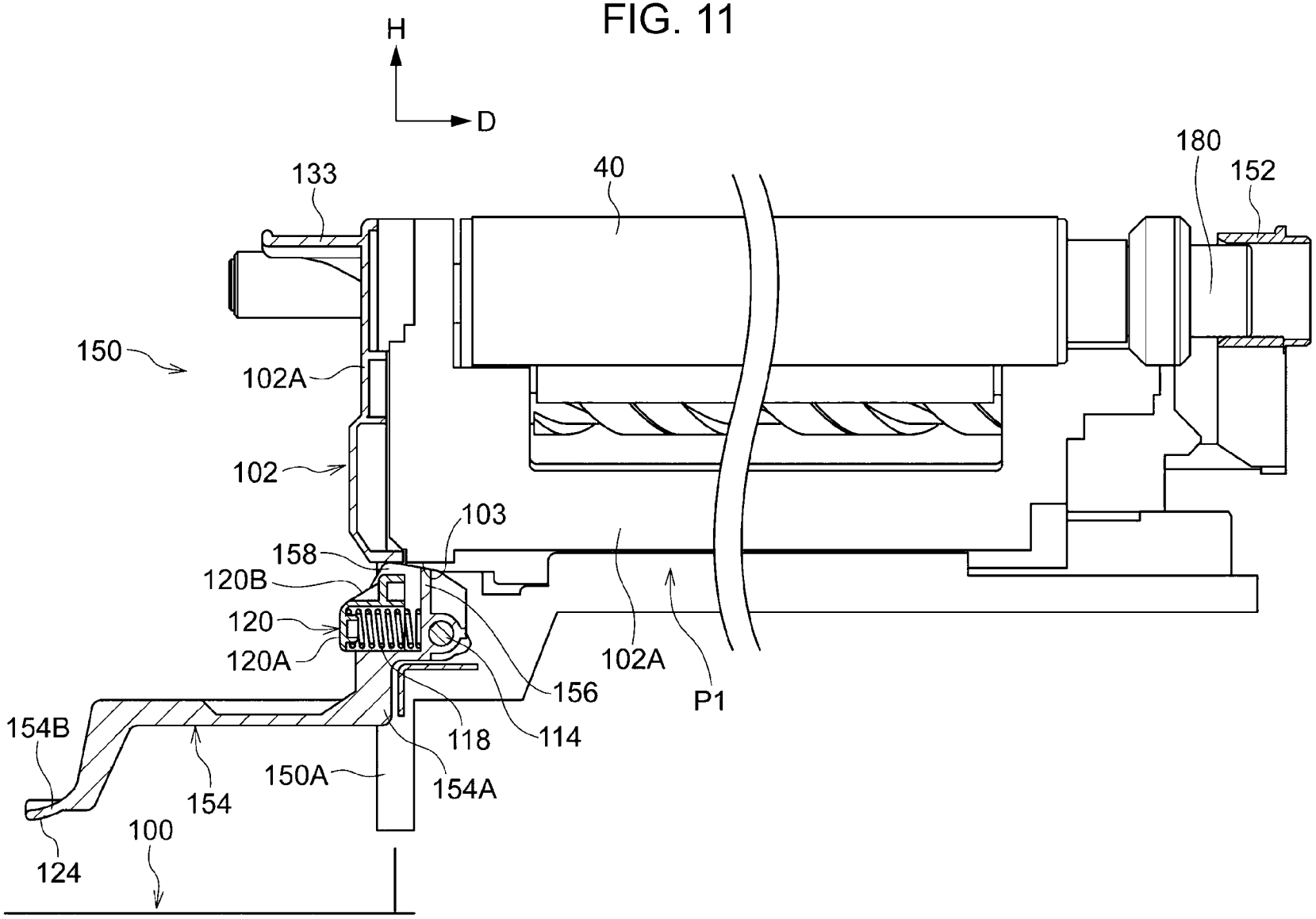
FIG. 11 is a schematic configuration diagram illustrating a state in which an image holder unit of an image forming apparatus according to a second exemplary embodiment is inserted to a front side of a deep part of an image forming apparatus body in a depth direction.

As illustrated in FIG. 11, an image forming apparatus 150 according to the second exemplary embodiment includes, in place of the levers 104 of the image forming apparatus 10 according to the first exemplary embodiment, levers 154 as an example of operation units. The levers 154 are rotatably supported by an apparatus body 150A as an example of an image forming apparatus body.

(Configuration of Levers 154)

The levers 154 each include a leading end part 154B and a base part 154A that is opposite the leading end part 154B. The leading end part 154B is an example of an operation object part, and the base part 154A is an example of a base side. As with the levers 104 in the first exemplary embodiment, upper parts of the levers 154 in the up/down direction are rotated around rotational axes 114 arranged in lower parts in the up/down direction. The coil springs 118 and supporting parts 156 that support the coil springs 118 are provided near the base parts 154A of the levers 154. More specifically, one end of each of the coil springs 118 is in contact with the supporting part 156 that is formed integrally with the base part 154A, and the other end of the coil spring 118 is in contact with the pressing member 120. Thus, the pressing member 120 is supported by the coil spring 118 that is supported by the supporting part 156 in such a manner that the pressing member 120 is able to be pressed toward the second position P2 (see FIG. 15). The coil spring 118 and the supporting part 156 are an example of supporting parts that support the pressing member 120 in such a manner that the pressing member 120 is able to be pressed toward the second position P2.

As illustrated in FIG. 11, a protrusion 158 that is in contact with the image holder unit 102 is provided on the supporting part 156 on a side farther away from the leading end part 154B than the slope surface 120B of the pressing member 120 is. The protrusion 158 protrudes in such a manner that a part of the protrusion 158 near the leading end part 154B of the lever 154 is higher than a part of the protrusion 158 near the depth direction (D direction) of the image holder unit 102. More specifically, in the state in which the lever 154 has not been operated (that is, in the state in which the lever 154 is rotated to the side opposite the apparatus body 150A side) as illustrated in FIG. 11, the protrusion height of a part of the protrusion 158 near the leading end part 154B of the lever 154 is higher than the protrusion height of a part of the protrusion 158 near the depth direction (D direction) of the image holder unit 102.

Figure 15:
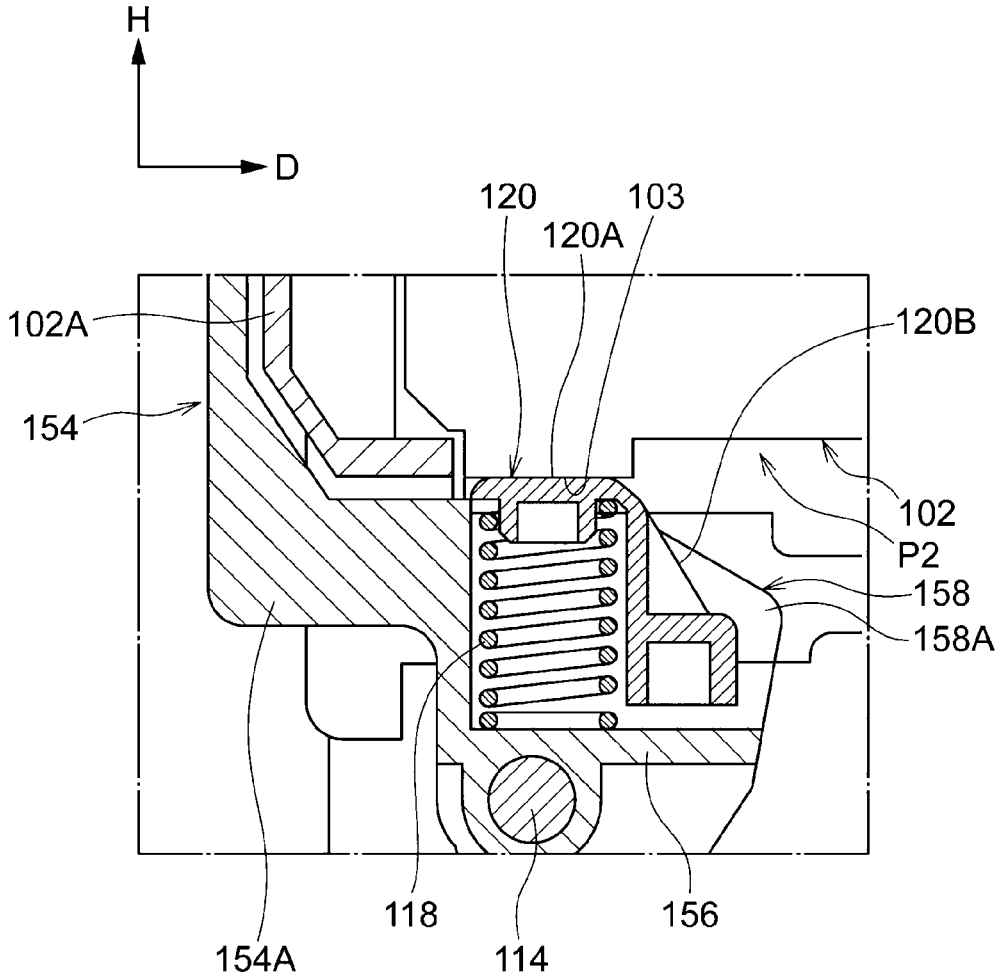
FIG. 15 is an enlarged cross-section view illustrating an area including and near a pressing member when the image holder unit is set to the second position in the image forming apparatus body by movement of the lever.

As illustrated in FIG. 15, in the state in which the lever 154 is rotated to the apparatus body 150A side, the protrusion 158 is arranged on an upper side of the supporting part 156. For example, the protrusion 158 has a shape that protrudes in a triangular shape toward the deep side in the depth direction (D direction) of the apparatus body 150A from a position lower than the pressing surface 120A of the pressing member 120 (see FIG. 15).

As illustrated in FIG. 15, the pressing member 120 moves the image holder unit 102 to the second position P2 by pressing the image holder unit 102 upward in the up/down direction by the pressing surface 120A.

FIGS. 13A to 13G illustrate a process for moving the image holder unit 102 by the protrusion 158 and the pressing member 120 when the lever 154 is rotated toward the apparatus body 150A (the arrow C direction). In FIGS. 14 and 15, a state in which the image holder unit 102 is positioned to the second position P2 in the apparatus body 150A by the pressing member 120 when rotation of the lever 154 to the apparatus body 150A side is completed is illustrated. Furthermore, FIGS. 16A to 16E illustrate states corresponding to the states illustrated in FIGS. 13A to 13E. FIGS. 16A to 16E schematically illustrate the movement path of the protrusion 158 when the lever 154 is rotated toward the apparatus body 150A (the arrow C direction) and the state of force applied to the image holder unit 102 from the protrusion 158.

As illustrated in FIGS. 13A to 13G, 14, and 15, the lever 154 has a shape that presses, based on an operation for rotating the lever 154 to the apparatus body 150A side, the image holder unit 102 to the deep part in the depth direction (D direction) of the apparatus body 150A from the first position P1 and then moves the image holder unit 102 from the deep part to the second position P2. More specifically, as illustrated in FIGS. 13A to 13D, the protrusion 158, which is arranged at the supporting part 156 of the lever 154 near the base part 154A, enters in contact with the image holder unit 102, and presses the image holder unit 102 to the deep part of the apparatus body 150A in the depth direction (D direction) from the first position P1. For example, the protrusion 158 enters in contact with an area near a corner part on a front side of the bottom surface 103 of the image holder unit 102, and presses the image holder unit 102 to the deep part of the apparatus body 150A in the depth direction (D direction) from the first position P1.

Figure 13A:
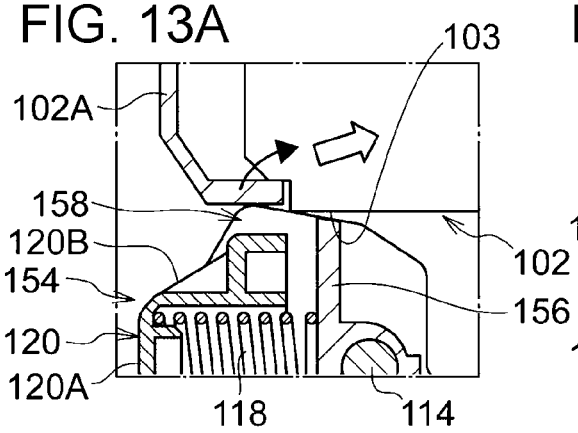
FIGS. 13A to 13G are enlarged configuration diagrams illustrating in order a process for moving the image holder unit by a lever when the lever is rotated toward the image forming apparatus body.
Figure 13B:
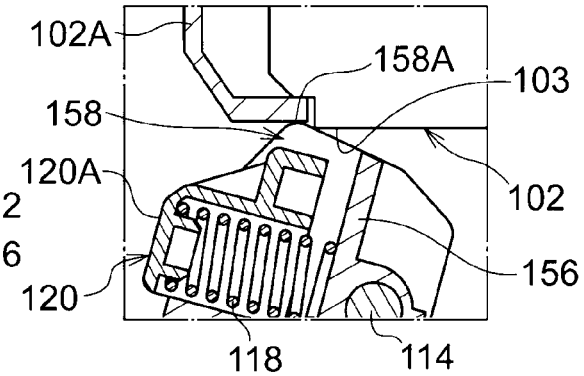
Figure 13C:
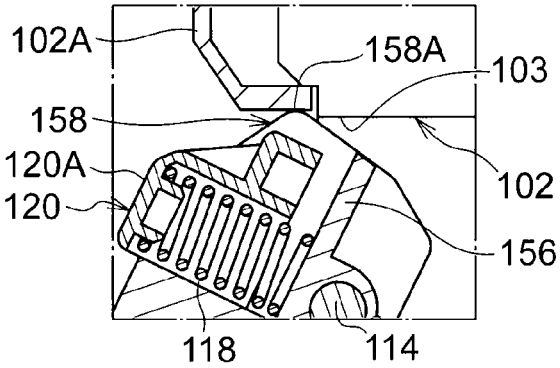
Figure 13D:
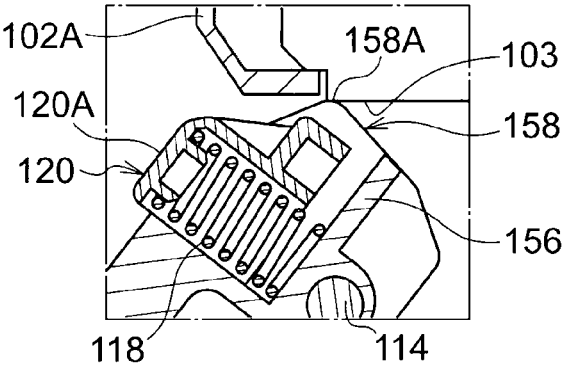
Figure 13E:
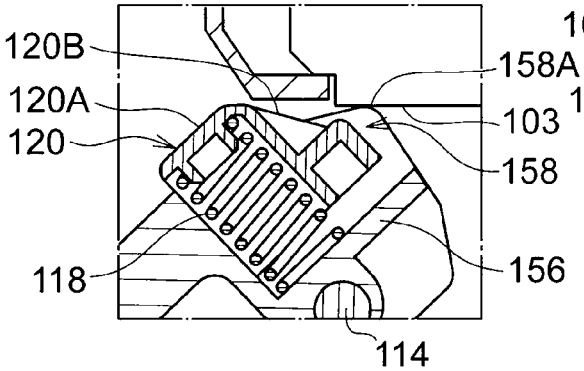
Figure 13F:
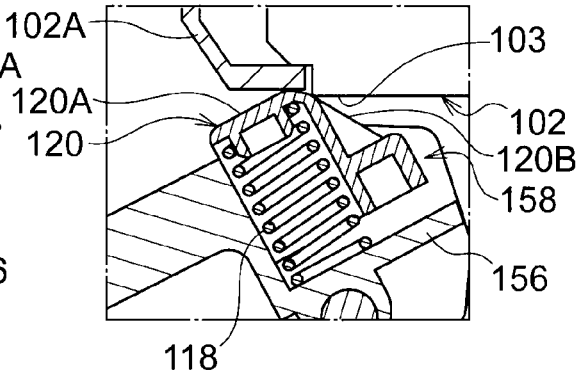
Figure 13G:
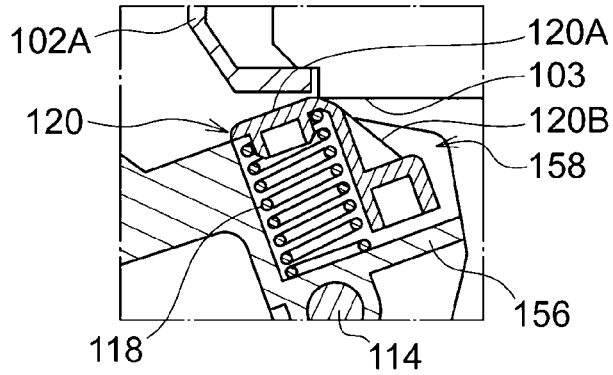
Figure 13G:
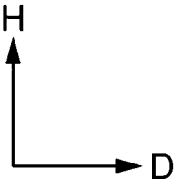
Figure 14:
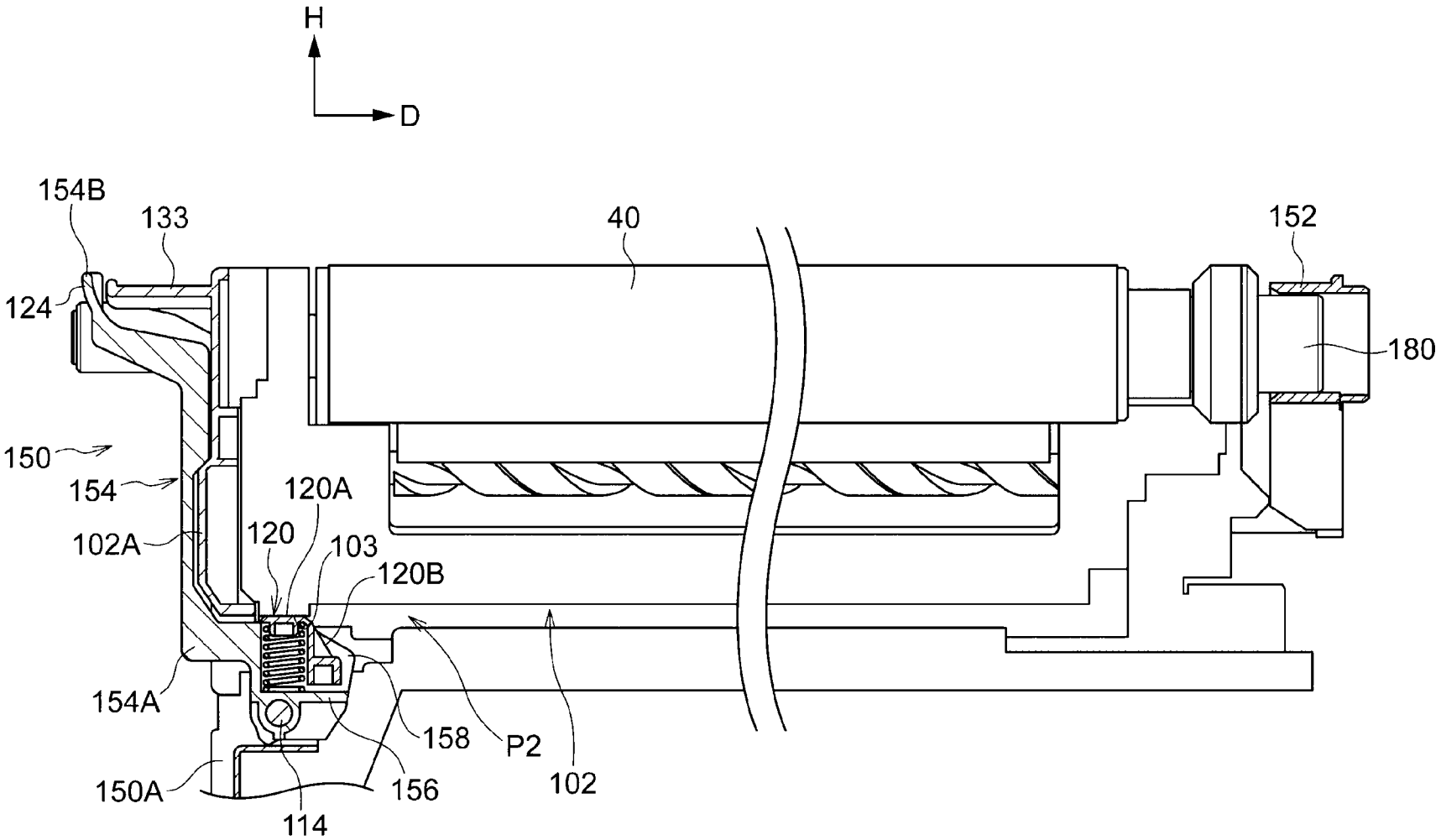
FIG. 14 is a schematic configuration diagram illustrating a state in which the image holder unit is set to a second position in the image forming apparatus body by movement of the lever.

Then, as illustrated in FIG. 13E, by an operation for causing the lever 154 to further rotate to the apparatus body 150A side, the protrusion 158 slips into below the bottom surface 103 of the image holder unit 102 and then slides on the bottom surface 103 of the image holder unit 102. Then, as illustrated in FIG. 13F, an area in the vicinity of the slope surface 120B of the pressing member 120 enters in contact with the bottom surface 103 of the image holder unit 102. Furthermore, as illustrated in FIGS. 13G and 15, by an operation for causing the lever 154 to further rotate to the apparatus body 150A side, the pressing surface 120A of the pressing member 120 enters in contact with the bottom surface 103 of the image holder unit 102, and presses the bottom surface 103 of the image holder unit 102 upward in the up/down direction to be moved to the second position P2.

Figure 16A:
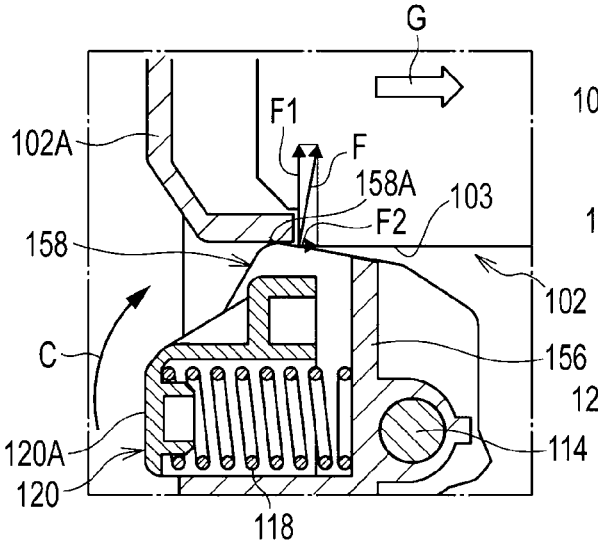
FIGS. 16A to 16E are enlarged configuration diagrams illustrating part of the process illustrated in FIGS. 13A to 13G and illustrate force applied to the image holder unit from a protrusion at a supporting part of the lever and a state in which the image holder unit moves.
Figure 16B:
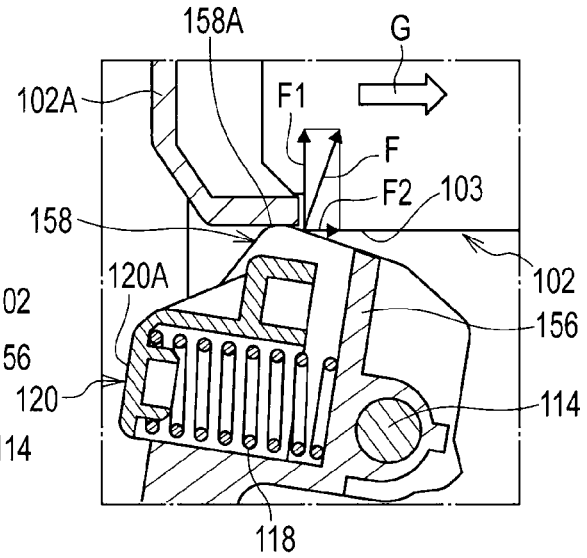
Figure 16C:
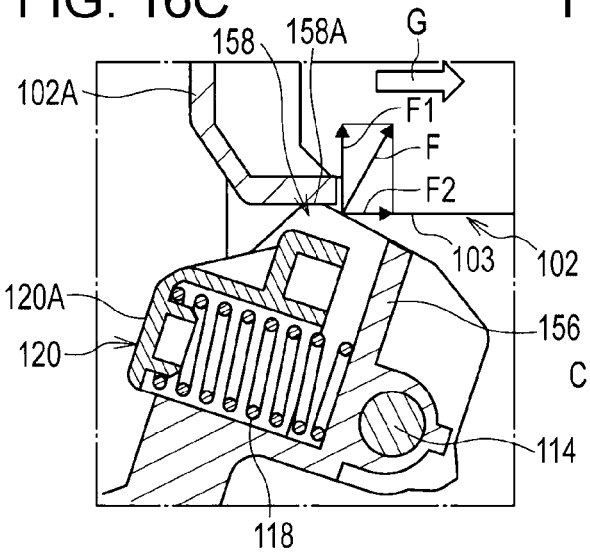
Figure 16D:
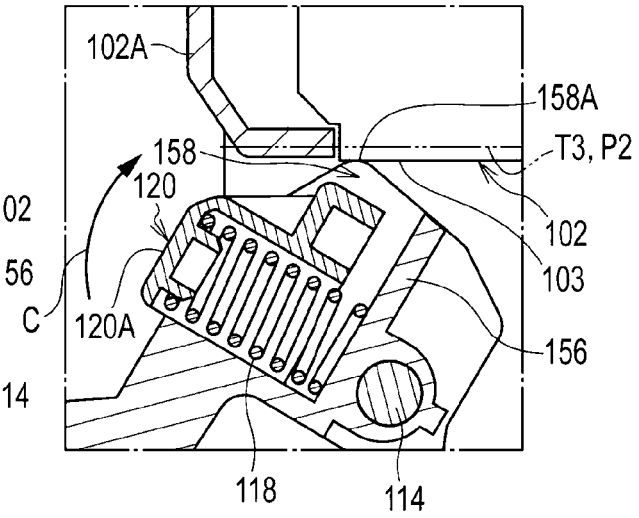
Figure 16E:
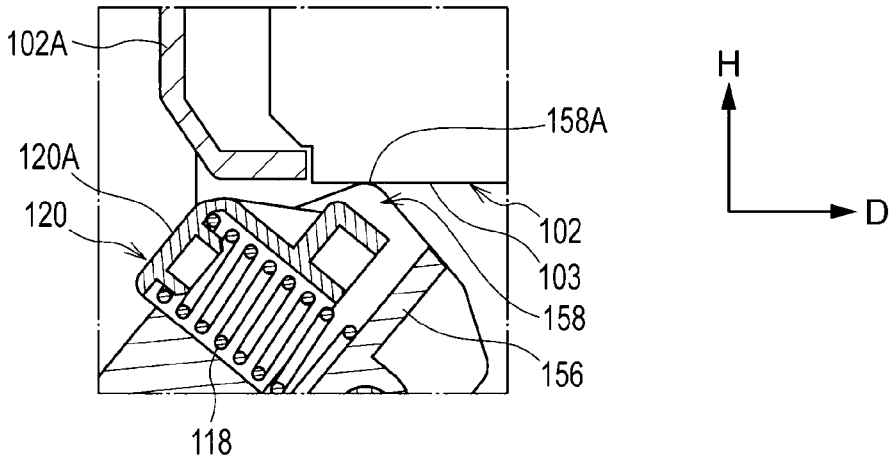

As illustrated in FIG. 16D, the maximum height of the movement path of the protrusion 158 while the lever 154 is rotating is lower than an installation position T3 on the bottom surface 103 of the image holder unit 102, which is arranged at the second position P2.

(Configuration of Components Other than Levers 154)

Figure 17:
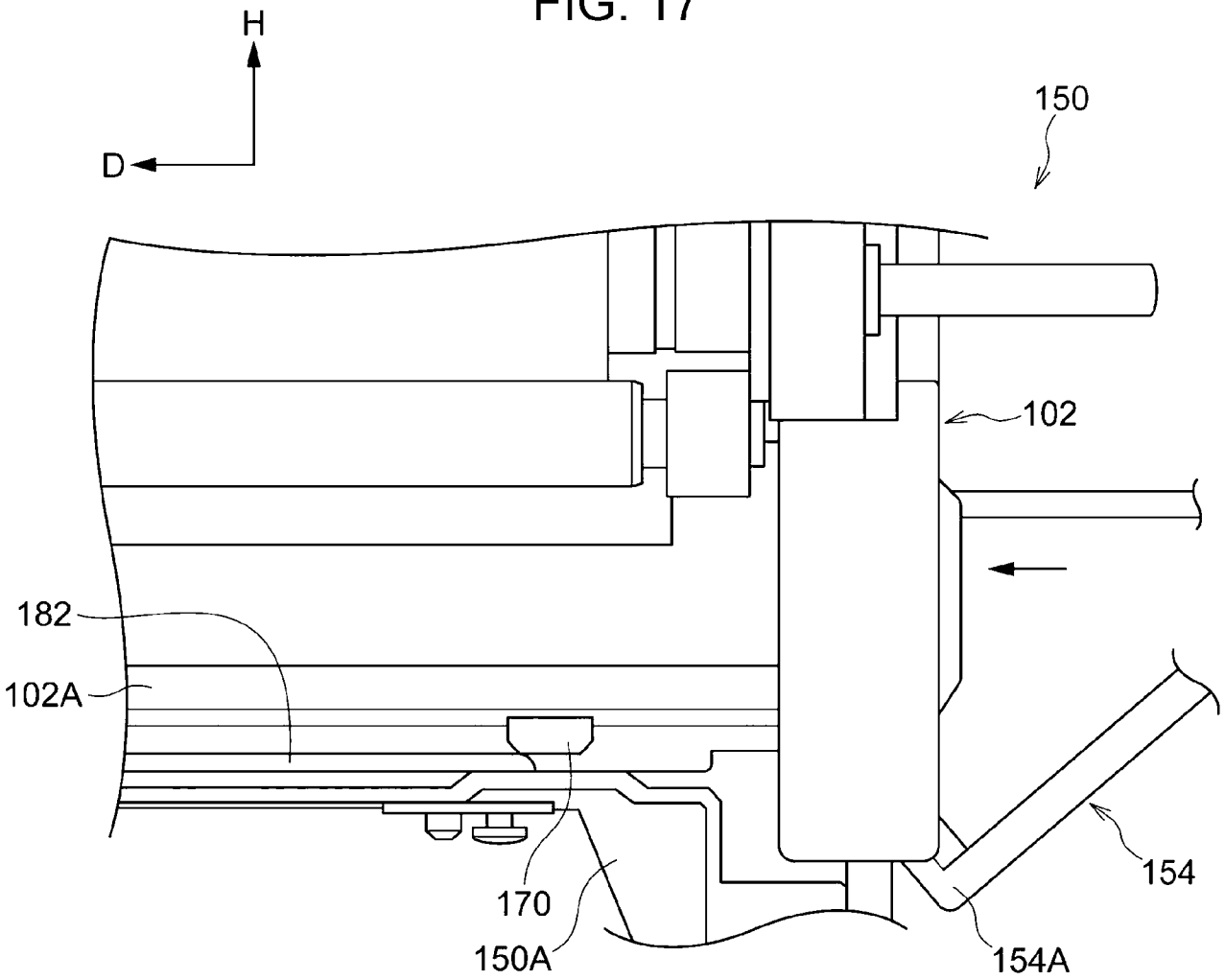
FIG. 17 is a schematic configuration diagram illustrating an area including and near a restriction part in a case where the image holder unit is disposed on the front side of the deep part of the image forming apparatus body in an insertion direction.

As illustrated in FIG. 17, the apparatus body 150A includes a restriction part 170 that restricts the image holder unit 102 from moving toward the second position P2 before the image holder unit 102 is pressed to the deep part in the depth direction (D direction). In the second exemplary embodiment, a rib 182 that protrudes toward a lateral side of the apparatus body 150A is provided along the depth direction (D direction) in a lower part of the image holder unit 102. The restriction part 170 is arranged at a position above the rib 182 in the up/down direction the apparatus body 150A in such a manner that the restriction part 170 and part of the rib 182 overlap. Thus, the image holder unit 102 does not move toward the second position P2, which is upward in the up/down direction, before the image holder unit 102 is pressed to the deep part in the depth direction (D direction) because the rib 182 interferes with the restriction part 170 (see FIG. 17).

Although not illustrated in drawings, in the state in which the image holder unit 102 is pressed to the deep part in the depth direction (D direction), the rib 182 moves out of the position that overlaps with the restriction part 170 in the up/down direction and thus does not interfere with the restriction part 170. Accordingly, the image holder unit 102 is able to be moved toward the second position P2, which is upward in the up/down direction.

In the image forming apparatus 150, in the case where an operation for causing the lever 154 to rotate to the apparatus body 150A side is not performed, the lever 154 may be rotated to the apparatus body 150A side by moving the cover 100 (FIG. 11) to the closed position P3, as in the first exemplary embodiment. The operation for moving the image holder unit 102 when the lever 154 is rotated to the apparatus body 150A side is the same between the case where the lever 154 is operated manually and the case where the lever 154 is rotated by moving the cover 100 (FIG. 11) to the closed position P3.

(Image Forming Apparatus According to First Comparative Example)

A configuration and a problem of the image forming apparatus 500 according to the first comparative example will be described below.

As illustrated in FIG. 20, in the image forming apparatus 500 according to the first comparative example, the image holder unit 506 is inserted into the apparatus body 500A up to the deepest part of the apparatus body 500A in the depth direction (D direction). Then, the lever 504 is rotated to the apparatus body 500A side so that the image holder unit 506 is positioned to the attachment position in the apparatus body 500A. As illustrated in FIG. 21, the spring 512 whose one end is in contact with the plunger 510 is provided near the base part 504A of the lever 504, and the other end of the spring 512 is in contact with the base part 504A of the lever 504.

In the image forming apparatus 500, the image holder unit 506 is positioned to the apparatus body 500A by rotating the lever 504 to the apparatus body 500A side and lifting the image holder unit 506 upward while causing the spring 512 to press a guide (installation surface) side of the apparatus body 500A.

Figure 22:
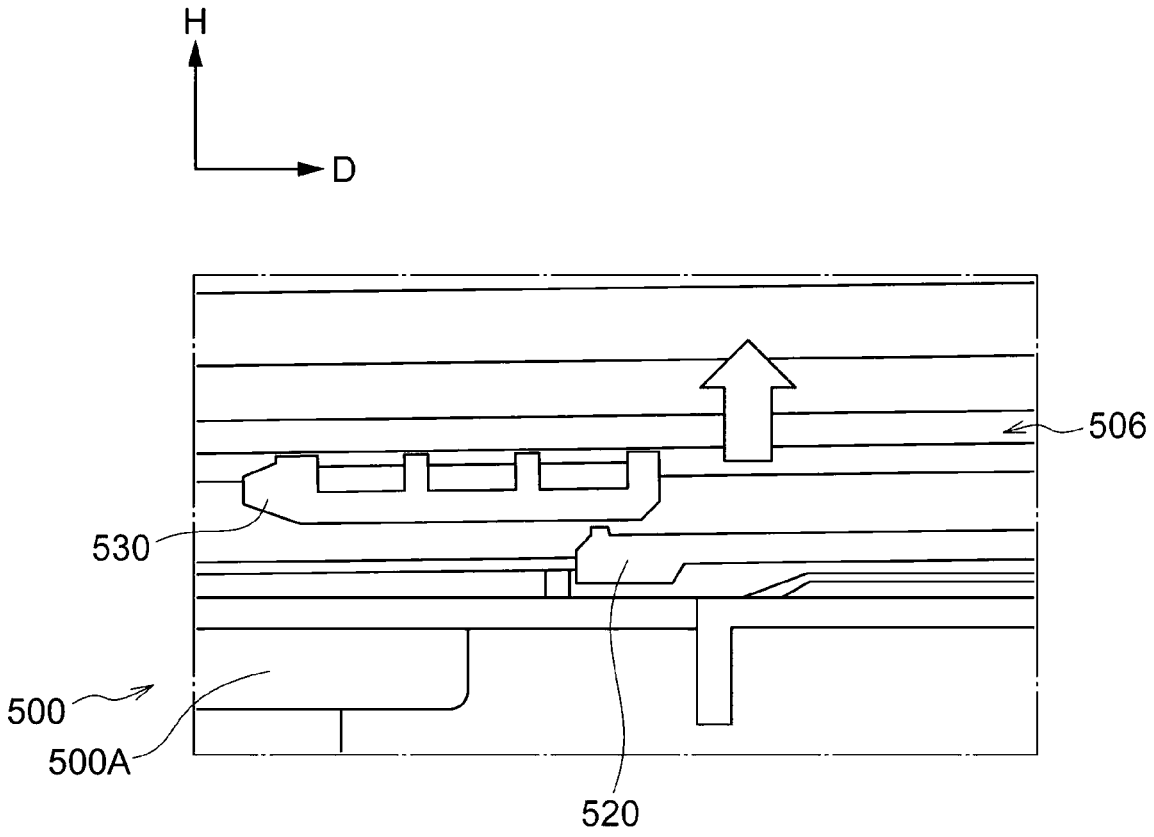
FIG. 22 is an enlarged configuration diagram illustrating part of the image holder unit of the image forming apparatus according to the first comparative example in a case where the image holder unit is disposed on the front side of a deep part of an image forming apparatus body in the insertion direction.

In the image forming apparatus 500, the direction in which the image holder unit 506 is inserted is different from the direction in which the image holder unit 506 is pressed for positioning. As illustrated in FIG. 22, the image holder unit 506 includes a rail part 520 along the depth direction (D direction). The apparatus body 500A includes a protrusion 530 that interferes with the rail part 520 of the image holder unit 506 in a state in which the image holder unit 506 is not inserted up to the deepest part of the apparatus body 500A in the depth direction (D direction). Thus, the rail part 520 of the image holder unit 506 abuts the protrusion 530 of the apparatus body 500A, and upward movement of the image holder unit 506 is thus restricted.

Accordingly, in the case where the image holder unit 506 is not inserted up to the deepest part of the apparatus body 500A in the depth direction (D direction), the rail part 520 of the image holder unit 506 abuts the protrusion 530 of the apparatus body 500A and the lever 504 is not lifted.

In the image forming apparatus 500 described above, if the attempt of positioning the image holder unit 506 to the apparatus body 500A is made without the image holder unit 506 being inserted up to the deepest part of the apparatus body 500A in the depth direction (D direction), the lever 504 does not move to the apparatus body 500A side, and this may be wrongly regarded as failure or malfunction. A further attempt to forcibly move the lever 504 to the apparatus body 500A side may break the lever 504.

(Operation and Effect of Second Exemplary Embodiment)

Next, operation and effect of the second exemplary embodiment will be described. In the image forming apparatus 150 according to the second exemplary embodiment, in addition to the operation and effect with a configuration similar to that of the image forming apparatus 10 according to the first exemplary embodiment, operation and effect described below are also attained.

In the image forming apparatus 150, the lever 154 includes, near the base part 154A, the coil spring 118 and the supporting part 156 that support the pressing member 120 in such a manner that the pressing member 120 is able to be pressed toward the second position P2. The protrusion 158 that is in contact with the image holder unit 102 is provided on the supporting part 156 on a side farther away from the leading end part 154B of the lever 154 than the slope surface 120B of the pressing member 120 is. A part of the protrusion 158 near the leading end part 154B of the lever 154 is higher than a part of the protrusion 158 near the depth direction (D direction) of the image holder unit 102 (see FIG. 11).

As illustrated in FIGS. 13A to 13D, when the lever 154 is rotated to the apparatus body 150A side (that is, the arrow C direction), the protrusion 158 enters in contact with the image holder unit 102, and presses the image holder unit 102 to the deep part of the apparatus body 150A in the depth direction (D direction) from the first position P1. For example, the protrusion 158 enters in contact with an area near a corner part on a front side of the bottom surface 103 of the image holder unit 102, and presses the image holder unit 102 to the deep part of the apparatus body 150A in the depth direction (D direction) from the first position P1.

Figure 12:
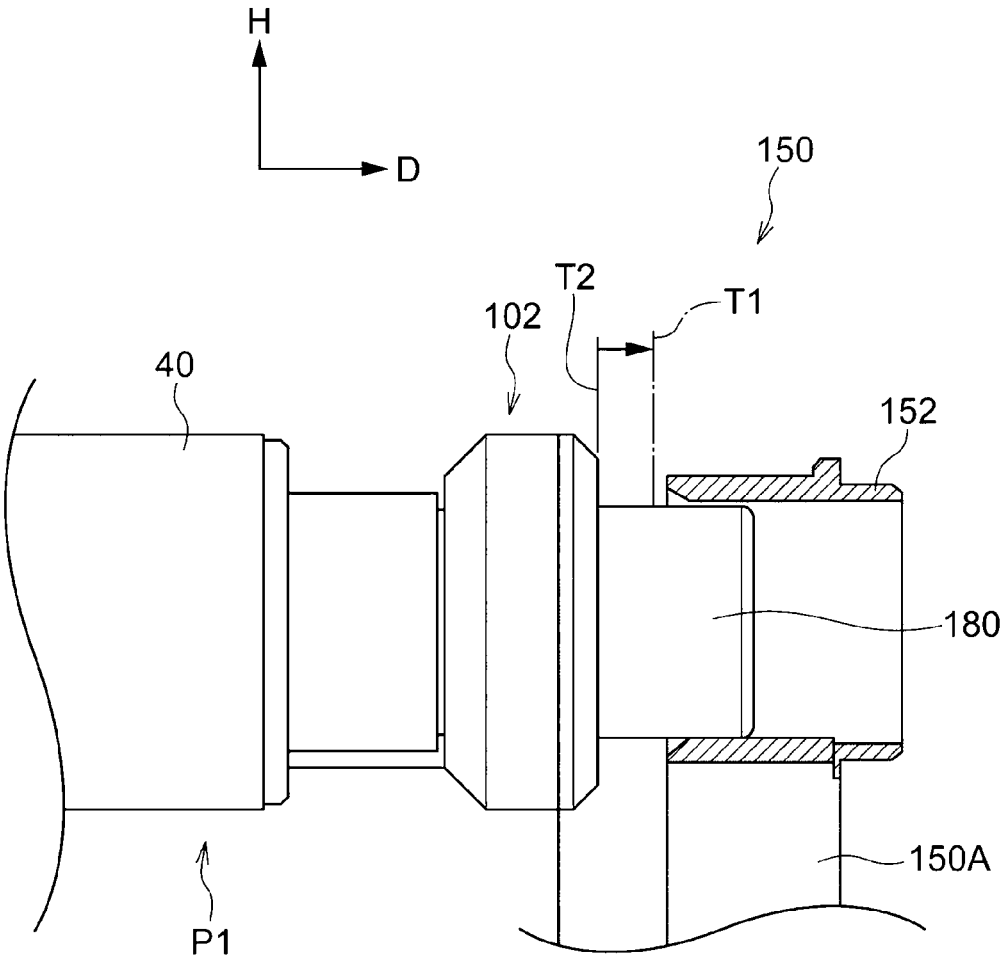
FIG. 12 is a schematic configuration diagram illustrating a state of an area near a deep part of the image holder unit of the image forming apparatus according to the second exemplary embodiment when the image holder unit is inserted to the front side of the deep part of the image forming apparatus body in the depth direction.

As illustrated in FIG. 12, for example, as the first position P1 that is different from a position in the apparatus body 150A to which the image holder unit 102 is positioned, an axis part 180 of the image holder 40 in the image holder unit 102 may be located at a position T2, which is on a front side in the depth direction (D direction) relative to a set position T1. In this state, as illustrated in FIGS. 13A to 13D, when the lever 154 is rotated toward the apparatus body 150A (arrow C direction), the protrusion 158 causes the image holder unit 102 to be pressed to the deep part of the apparatus body 150A in the depth direction (D direction) from the first position P1.

At this time, as illustrated in FIG. 16A, the protrusion 158 of the lever 154 presses the bottom surface 103 of the image holder unit 102 diagonally upward as indicated by force F. Upward force from the protrusion 158 (see F1) and force in the insertion direction (see F2) are applied to the bottom surface 103 of the image holder unit 102. The upward force F1 moves on the slope of the protrusion 158 that is balanced with the gravity of the image holder unit 102. For example, when the protrusion 158 enters in contact with the area near the corner part on the front side of the bottom surface 103 of the image holder unit 102 in the insertion direction (D direction), the insertion-direction force F2 is applied from the protrusion 158. Thus, the protrusion 158 presses the image holder unit 102 to the deep part of the apparatus body 150A in the depth direction (D direction).

As illustrated in FIGS. 16B and 16C, when the lever 154 is rotated to the apparatus body 150A side and the slope on the protrusion 158 becomes steeper, the insertion-direction force F2 gradually increases, and the position at which balance with the gravity of the image holder unit 102 is obtained moves to the deep side in the insertion direction (D direction). Thus, the image holder unit 102 is further pressed to the deep part of the apparatus body 150A in the depth direction (D direction).

As illustrated in FIG. 16D, when the image holder unit 102 abuts the deep part of the apparatus body 150A in the depth direction (D direction), the protrusion 158 slips into below a bottom surface 130 of the image holder unit 102 and then slides on the bottom surface 130 of the image holder unit 102 (see FIG. 16F). The maximum height of the movement path of the protrusion 158 while the lever 154 is rotating is lower than the installation position T3 on the bottom surface 130 of the image holder unit 102, which is arranged at the second position P2. Thus, the protrusion 158 slips into below the bottom surface 130 of the image holder unit 102.

Figure 18:
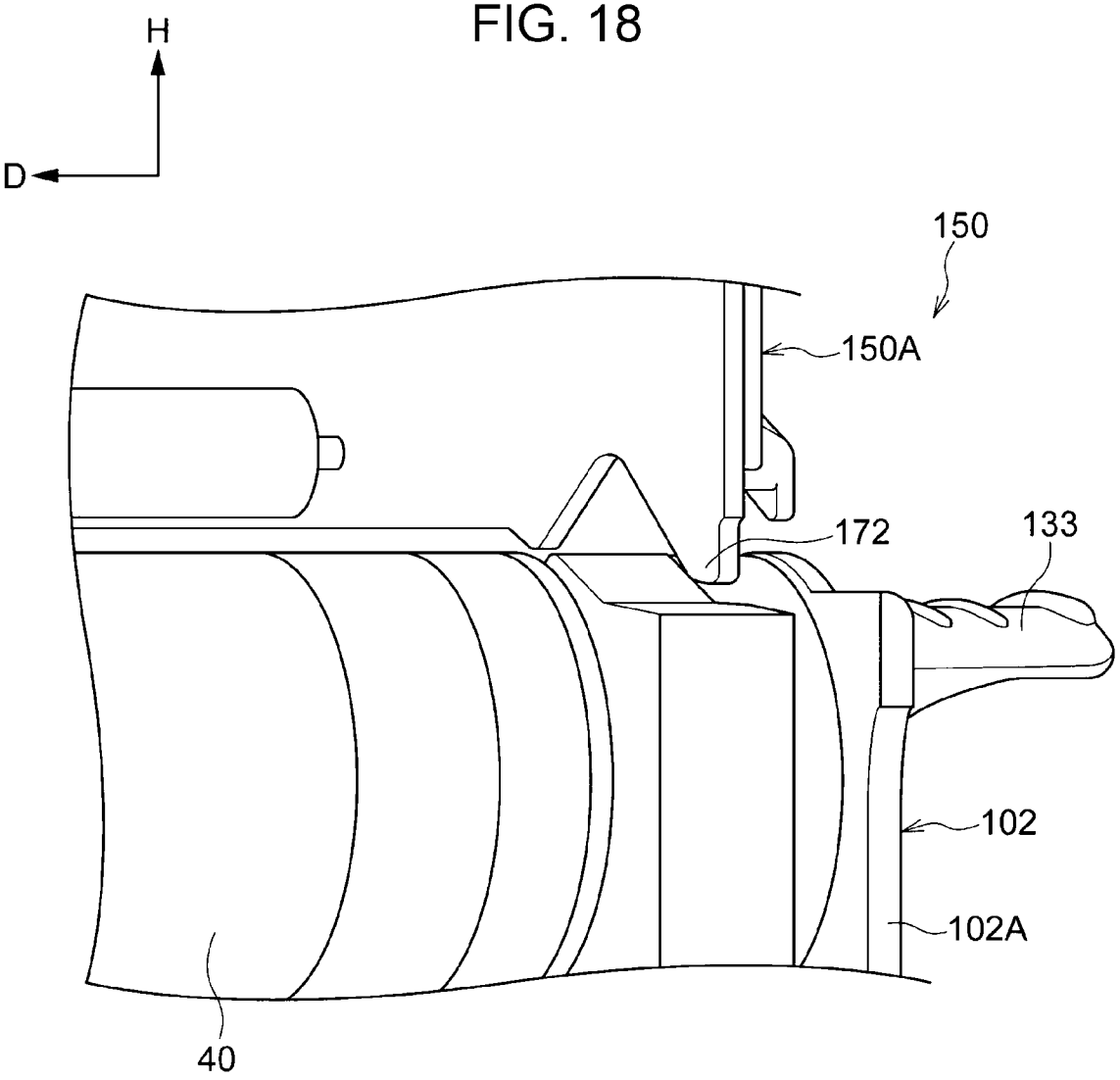
FIG. 18 is a schematic perspective view illustrating an area including and near the image holder in a case where the image holder unit is disposed on the front side of deepest part of the image forming apparatus body in the insertion direction.

As illustrated in FIGS. 13F and 13G, when the protrusion 158 passes through the bottom surface 130 of the image holder unit 102, the pressing member 120 presses the bottom surface 130 of the image holder unit 102 upward and presses and fixes the image holder unit 102 to the second position P2. For example, as illustrated in FIG. 18, the image forming apparatus 150 includes, on the front side of the apparatus body 150A in the depth direction (D direction), a positioning unit 172 that extends downward from an upper part of the apparatus body 150A. Although not illustrated in FIG. 18, when an upper part of the housing 102A on the front side of the image holder unit 102 in the depth direction (D direction) abuts the positioning unit 172 of the apparatus body 150A, the image holder unit 102 is pressed and fixed to the second position P2.

As described above, in the image forming apparatus 150, the protrusion 158 that is in contact with the image holder unit 102 is provided on the supporting part 156 of the lever 154 on a side farther away from the leading end part 154B than the slope surface 120B of the pressing member 120 is.

Thus, compared to a case where a part of the supporting part that is farther away from the leading end part of the lever than the slope surface is flat, the image holder unit 102 may be moved in the depth direction of the apparatus body 150A by an operation of the lever 154 in the image forming apparatus 150.

Furthermore, an upper part of the lever 154 in the up/down direction is rotated around the rotational axis 114 arranged in a lower part of the lever 154 in the up/down direction, and the protrusion 158 is arranged in an upper part of the supporting part 156 in a state in which the lever 154 is rotated to the apparatus body 150A side (see FIGS. 14 and 15). The pressing member 120 presses the image holder unit 102 upward in the up/down direction to be moved to the second position P2.

Thus, compared to a case where the lever is arranged in a direction intersecting the up/down direction, the rotation operation of the lever 154 may press the image holder unit 102 to the depth direction and lift the image holder unit 102 upward in the up/down direction to be moved to the second position P2 in the image forming apparatus 150.

Furthermore, the maximum height of the movement path of the protrusion 158 while the lever 154 is rotating is lower than the bottom surface 103 (see the installation position T3 on the bottom surface 103) of the image holder unit 102, which is arranged at the second position P2 (see FIG. 16D).

Thus, compared to a case where the maximum height of the movement path of the protrusion while the lever is rotating is the same as the bottom surface of the image holder unit arranged at the second position, the rotation operation of the lever 154 may press the image holder unit 102 to the depth direction (D direction) and then lift the image holder unit 102 upward in the up/down direction to be moved to the second position P2 in the image forming apparatus 150.

Furthermore, the lever 154 has a shape that presses, by an operation for moving the lever 154 to the apparatus body 150A side, the image holder unit 102 to the deep part of the apparatus body 150A in the depth direction (D direction) from the first position P1 and moves the image holder unit 102 to the second position P2 from the deep part. In the second exemplary embodiment, the protrusion 158 of the lever 154 causes the image holder unit 102 to be pressed to the deep part of the apparatus body 150A in the depth direction (D direction) from the first position P1.

Thus, compared to a case where an operation for moving the lever to the apparatus body side causes the image holder unit to be moved from the first position in a direction intersecting the depth direction to be disposed at the second position, interference between a component of the image holder unit 102 and the apparatus body 150A may be reduced in the image forming apparatus 150.

Furthermore, the apparatus body 150A includes the restriction part 170 that restricts the image holder unit 102 from moving toward the second position P2 before the image holder unit 102 is pressed to the deep part of the apparatus body 150A in the depth direction (D direction). In the second exemplary embodiment, because the rib 182 of the image holder unit 102 interferes with the restriction part 170 of the apparatus body 150A, the image holder unit 102 is not moved to the second position P2, which is upward in the up/down direction.

Thus, compared to a case where part of the image holder unit 102 does not enter in contact with the apparatus body before the image holder unit 102 is pressed to the deep part in the depth direction, interference between a component of the image holder unit 102 and the apparatus body 150A may be reduced in the image forming apparatus 150. For example, contact between the image holder 40 of the image holder unit 102 and the apparatus body 150A may be suppressed.

<Others>

The present disclosure is not limited to the exemplary embodiments described above, and design may be changed in an appropriate manner without departing from the gist of the present disclosure.

Although the levers 104 are provided in the apparatus body 10A in the first exemplary embodiment, the present disclosure is not limited this configuration. For example, the levers 104 may be provided in the image holder units 102.

Although the protrusions 158 are provided at the supporting parts 156 of the levers 154 in the second exemplary embodiment, shapes of the protrusions 158 may be changed. Furthermore, positions at which the protrusions 158 contact the image holder units 102 when the levers 154 are rotated to the apparatus body 150A side and shapes of the image holder units 102 may be changed in an appropriate manner as long as the protrusions 158 are able to press the image holder units 102 in the depth direction (D direction).

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1)))

An image forming apparatus comprising a detachable body that is able to be attached to and detached from an image forming apparatus body in a depth direction and is movable from a first position to a second position; an operation unit that is operated in a direction approaching the image forming apparatus body to position the detachable body from the first position to the second position; and a pressing member that presses the detachable body toward the second position with a pressing surface in contact with the detachable body in a state in which an operation of the operation unit is completed and moves the detachable body from the first position to the second position with a slope surface forming an obtuse angle with respect to the pressing surface in contact with the detachable body in accordance with the operation of the operation unit.

(((2)))

The image forming apparatus according to (((1))), wherein the operation unit includes an operation object part and a supporting part that is provided near a base side of the operation object part and supports the pressing member in such a manner that the pressing member is able to be pressed toward the second position, wherein the supporting part includes, on a side farther away from the operation object part than the slope surface is, a protrusion that is in contact with the detachable body, and wherein a part of the protrusion near the operation object part is higher than a part of the protrusion near the depth direction of the detachable body.

(((3)))

The image forming apparatus according to (((2))), wherein an upper part of the operation unit in an up/down direction rotates around a rotational axis arranged in a lower part of the operation unit in the up/down direction, wherein the protrusion is arranged in an upper part of the supporting part in a state in which the operation unit is rotated to the image forming apparatus body side, and wherein the pressing member presses the detachable body upward in the up/down direction so that the detachable body is moved to the second position.

(((4)))

The image forming apparatus according to (((3))), wherein a maximum height of a movement path of the protrusion while the operation unit is rotating is lower than a bottom surface of the detachable body arranged at the second position.

(((5)))

The image forming apparatus according to any one of (((1))) to (((4))), further comprising a cover member that is provided movably between a closed position at which inside of the image forming apparatus body is covered and an open position at which the inside of the image forming apparatus body is exposed and, when the cover member is moved toward the closed position, enters in contact with the operation unit that has not been operated, wherein over an entire operation range of the operation unit on the cover member, an area of the cover member that is in contact with the operation unit is flat.

(((6)))

The image forming apparatus according to (((5))), wherein an upper part of the cover member in the up/down direction is rotated around an axis part arranged in a lower part of the cover member in the up/down direction, and the cover member is moved between the open position and the closed position.

(((7)))

The image forming apparatus according to (((5))) or (((6))), wherein the cover member is a collection box that collects waste toner.

(((8)))

The image forming apparatus according to (((2))) or (((3))), wherein the operation unit is provided at the image forming apparatus body.

(((9)))

The image forming apparatus according to any one of (((5))) to (((8))), wherein a leading end of the operation unit that has not been operated is in plane contact with the cover member.

(((10)))

The image forming apparatus according to any one of (((1))) to (((9))), further comprising a biasing member that biases the pressing member toward the second position, wherein a center position in a biasing direction of the biasing member is a position at which moment is applied to a rotational axis of the operation unit in a direction in which the operation unit is moved toward the image forming apparatus body.

(((11)))

The image forming apparatus according to any one of (((1))) to (((10))), wherein a grip part of the operation unit has a shape that covers a handle of the detachable body in a state in which the operation unit is moved to the image forming apparatus body side.

(((12)))

The image forming apparatus according to any one of (((1))) to (((11))), wherein the operation unit has a shape that presses, by an operation for moving the operation unit to the image forming apparatus body side, the detachable body to a deep part of the image forming apparatus body in the depth direction from the first position and moves the detachable body to the second position from the deep part.

(((13)))

The image forming apparatus according to any one of (((1))) to (((12))), wherein the image forming apparatus body includes a restriction part that restricts the detachable body from moving toward the second position before the detachable body is pressed to a deep part of the image forming apparatus body in the depth direction.

What is claimed is:

1. An image forming apparatus comprising:

a detachable body that is able to be attached to and detached from an image forming apparatus body in a depth direction and is movable from a first position to a second position;

an operation unit that is operated in a direction approaching the image forming apparatus body to position the detachable body from the first position to the second position; and a pressing member that presses the detachable body toward the second position with a pressing surface in contact with the detachable body in a state in which an operation of the operation unit is completed and moves the detachable body from the first position to the second position with a slope surface forming an obtuse angle with respect to the pressing surface in contact with the detachable body in accordance with the operation of the operation unit.

2. The image forming apparatus according to claim 1, wherein the operation unit includes an operation object part and a supporting part that is provided near a base side of the operation object part and supports the pressing member in such a manner that the pressing member is able to be pressed toward the second position, wherein the supporting part includes, on a side farther away from the operation object part than the slope surface is, a protrusion that is in contact with the detachable body, and wherein a part of the protrusion near the operation object part is higher than a part of the protrusion near the depth direction of the detachable body.

3. The image forming apparatus according to claim 2, wherein an upper part of the operation unit in an up/down direction rotates around a rotational axis arranged in a lower part of the operation unit in the up/down direction, wherein the protrusion is arranged in an upper part of the supporting part in a state in which the operation unit is rotated to the image forming apparatus body side, and wherein the pressing member presses the detachable body upward in the up/down direction so that the detachable body is moved to the second position.

4. The image forming apparatus according to claim 3, wherein a maximum height of a movement path of the protrusion while the operation unit is rotating is lower than a bottom surface of the detachable body arranged at the second position.

5. The image forming apparatus according to claim 3, wherein the operation unit is provided at the image forming apparatus body.

6. The image forming apparatus according to claim 2, wherein the operation unit is provided at the image forming apparatus body.

7. The image forming apparatus according to claim 2, wherein a grip part of the operation unit has a shape that covers a handle of the detachable body in a state in which the operation unit is moved to the image forming apparatus body side.

8. The image forming apparatus according to claim 1, further comprising:

a cover member that is provided movably between a closed position at which inside of the image forming apparatus body is covered and an open position at which the inside of the image forming apparatus body is exposed and, when the cover member is moved toward the closed position, enters in contact with the operation unit that has not been operated, wherein over an entire operation range of the operation unit on the cover member, an area of the cover member that is in contact with the operation unit is flat.

9. The image forming apparatus according to claim 8, wherein an upper part of the cover member in the up/down direction is rotated around an axis part arranged in a lower part of the cover member in the up/down direction, and the cover member is moved between the open position and the closed position.

10. The image forming apparatus according to claim 8, wherein the cover member is a collection box that collects waste toner.

11. The image forming apparatus according to claim 8, wherein a leading end of the operation unit that has not been operated is in plane contact with the cover member.

12. The image forming apparatus according to claim 8, further comprising:

a biasing member that biases the pressing member toward the second position, wherein a center position in a biasing direction of the biasing member is a position at which moment is applied to a rotational axis of the operation unit in a direction in which the operation unit is moved toward the image forming apparatus body.

13. The image forming apparatus according to claim 1, further comprising:

a biasing member that biases the pressing member toward the second position, wherein a center position in a biasing direction of the biasing member is a position at which moment is applied to a rotational axis of the operation unit in a direction in which the operation unit is moved toward the image forming apparatus body.

14. The image forming apparatus according to claim 1, wherein a grip part of the operation unit has a shape that covers a handle of the detachable body in a state in which the operation unit is moved to the image forming apparatus body side.

15. The image forming apparatus according to claim 1, wherein the operation unit has a shape that presses, by an operation for moving the operation unit to the image forming apparatus body side, the detachable body to a deep part of the image forming apparatus body in the depth direction from the first position and moves the detachable body to the second position from the deep part.

16. The image forming apparatus according to claim 15, wherein the image forming apparatus body includes a restriction part that restricts the detachable body from moving toward the second position before the detachable body is pressed to a deep part of the image forming apparatus body in the depth direction.

17. The image forming apparatus according to claim 1, wherein the image forming apparatus body includes a restriction part that restricts the detachable body from moving toward the second position before the detachable body is pressed to a deep part of the image forming apparatus body in the depth direction.

18. An image forming apparatus comprising:

detachable body means for being able to be attached to and detached from an image forming apparatus body in a depth direction and being movable from a first position to a second position;

operation means for being operated in a direction approaching the image forming apparatus body to position the detachable body from the first position to the second position; and pressing means for pressing the detachable body toward the second position with a pressing surface in contact with the detachable body in a state in which an operation of the operation means is completed and moving the detachable body from the first position to the second position with a slope surface forming an obtuse angle with respect to the pressing surface in contact with the detachable body in accordance with the operation of the operation unit.

* * * * *